US011078612B2

(12) United States Patent
Chung et al.

(10) Patent No.: US 11,078,612 B2
(45) Date of Patent: Aug. 3, 2021

(54) WASHING MACHINE AND METHOD OF CONTROLLING THE SAME

(71) Applicant: SAMSUNG ELECTRONICS CO., LTD., Suwon-si (KR)

(72) Inventors: Seung Eun Chung, Yongin-si (KR); Da Eun Kim, Seoul (KR); In Sik Park, Seongnam-si (KR); Dong Woo Lee, Yongin-si (KR); Jin Young Choi, Seongnam-si (KR); Jin Han Kim, Suwon-si (KR); Hyun Soo Park, Seoul (KR); Sung Chan Yun, Suwon-si (KR); Seok-Mo Chang, Incheon (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/700,759

(22) Filed: Dec. 2, 2019

(65) Prior Publication Data

US 2020/0102681 A1 Apr. 2, 2020

Related U.S. Application Data

(63) Continuation of application No. 15/151,258, filed on May 10, 2016, now Pat. No. 10,513,812.
(Continued)

(30) Foreign Application Priority Data

Apr. 27, 2016 (KR) ..... 10-2016-0051475

(51) Int. Cl.
*D06F 17/04* (2006.01)
*D06F 33/00* (2020.01)
(Continued)

(52) U.S. Cl.
CPC ..... *D06F 33/00* (2013.01); *D06F 17/04* (2013.01); *D06F 39/04* (2013.01); *D06F 17/10* (2013.01);
(Continued)

(58) Field of Classification Search
CPC ..... D06F 33/00; D06F 17/04; D06F 17/10; D06F 39/04; D06F 39/088; D06F 39/14;
(Continued)

(56) References Cited

U.S. PATENT DOCUMENTS

2002/0088061 A1 7/2002 Kown
2005/0224099 A1 10/2005 Luckman et al.
(Continued)

FOREIGN PATENT DOCUMENTS

CN 1370261 A 9/2002
CN 1537991 A 10/2004
(Continued)

OTHER PUBLICATIONS

KR200285807Y1—Machine translation (Year: 2002).*
(Continued)

*Primary Examiner* — Tinsae B Ayalew
(74) *Attorney, Agent, or Firm* — Staas & Halsey, LLP

(57) ABSTRACT

A washing machine which performs a washing operation by heating water, a detergent, or a wash liquid using a dielectric heating method and a method of controlling the washing machine. The washing machine may include a water supply portion which supplies a wash liquid including water and a detergent, a power supply portion which supplies alternating current (AC) power, and an electric field forming portion which forms an electric field between a first electrode portion and a second electrode portion according to the AC power to heat the supplied wash liquid.

12 Claims, 35 Drawing Sheets

Related U.S. Application Data

(60) Provisional application No. 62/159,664, filed on May 11, 2015.

(51) Int. Cl.

| | |
|---|---|
| ***D06F 39/04*** | (2006.01) |
| *D06F 35/00* | (2006.01) |
| *D06F 37/14* | (2006.01) |
| *D06F 39/08* | (2006.01) |
| *D06F 37/04* | (2006.01) |
| *D06F 37/06* | (2006.01) |
| *D06F 37/20* | (2006.01) |
| *D06F 37/12* | (2006.01) |
| *D06F 17/10* | (2006.01) |
| *D06F 39/14* | (2006.01) |
| *D06F 29/00* | (2006.01) |
| *D06F 34/18* | (2020.01) |
| *D06F 34/22* | (2020.01) |

(52) U.S. Cl.

CPC ..... *D06F 29/00* (2013.01); *D06F 34/18* (2020.02); *D06F 34/22* (2020.02); *D06F 35/003* (2013.01); *D06F 35/005* (2013.01); *D06F 37/04* (2013.01); *D06F 37/06* (2013.01); *D06F 37/12* (2013.01); *D06F 37/14* (2013.01); *D06F 37/20* (2013.01); *D06F 39/088* (2013.01); *D06F 39/14* (2013.01); *D06F 2202/02* (2013.01); *D06F 2202/04* (2013.01); *D06F 2202/10* (2013.01); *D06F 2204/04* (2013.01); *D06F 2204/06* (2013.01); *D06F 2204/10* (2013.01)

(58) Field of Classification Search

CPC ..... D06F 34/22; D06F 34/18; D06F 29/00; D06F 35/003; D06F 35/005; D06F 37/04; D06F 37/06; D06F 37/12; D06F 37/14; D06F 37/20; D06F 2202/02; D06F 2202/04; D06F 2202/10; D06F 2204/04; D06F 2204/06; D06F 2204/10

USPC ..... 8/137

See application file for complete search history.

(56) References Cited

U.S. PATENT DOCUMENTS

| | | | |
|---|---|---|---|
| 2008/0202569 | A1 | 8/2008 | Chandra et al. |
| 2011/0012584 | A1 | 1/2011 | Ivanov et al. |
| 2011/0049133 | A1 | 3/2011 | Przybyla |
| 2011/0299840 | A1 | 12/2011 | Wielstra |
| 2011/0308101 | A1 | 12/2011 | Wisherd et al. |

FOREIGN PATENT DOCUMENTS

| | | | | |
|---|---|---|---|---|
| CN | 101889472 | A | 11/2010 | |
| CN | 104583136 | A | 4/2015 | |
| EP | 0 462 078 | A2 | 12/1991 | |
| EP | 0 462 078 | A3 | 12/1991 | |
| EP | 0462078 | A2 * | 12/1991 | ..... D06F 39/04 |
| KR | 1993-0006238 | | 4/1993 | |
| KR | 1998-067626 | | 10/1998 | |
| KR | 20-0285807 | | 4/2002 | |
| KR | 10-2004-0091194 | | 10/2004 | |
| WO | WO 94/12716 | | 6/1994 | |
| WO | 2008/153285 | | 12/2008 | |
| WO | WO 2013/178722 | A2 | 12/2013 | |
| WO | WO 2013/178722 | A3 | 12/2013 | |
| WO | WO-2013178722 | A2 * | 12/2013 | ..... C02F 1/48 |

OTHER PUBLICATIONS

Chinese Patent Office Action issued in Chinese Patent Application No. 201680018555.6 dated Oct. 11, 2019.

European Office Action dated Feb. 11, 2020 in European Patent Application No. 16792977.7.

English Translation of Chinese Office Action dated May 22, 2020, in corresponding Chinese Patent Application No. 201680018555.6.

International Search Report dated Aug. 16, 2016 from International Patent Application No. PCT/KR2016/004914, 5 pages.

Extended European Search Report dated Mar. 26, 2018, in corresponding European Patent Application No. 16792977.7.

Office Action Restriction dated Sep. 4, 2018 in co-pending U.S. Appl. No. 15/151,258.

Non-Final Office Action dated Nov. 29, 2018 in co-pending U.S. Appl. No. 15/151,258.

Final Office Action dated Apr. 25, 2019 in co-pending U.S. Appl. No. 15/151,258.

Advisory Action dated Jul. 15, 2019 in co-pending U.S. Appl. No. 15/151,258.

Notice of Allowance dated Aug. 6, 2019 in co-pending U.S. Appl. No. 15/151,258.

U.S. Appl. No. 15/151,258, filed May 10, 2016, Seung Eun Chung et al., Samsung Electronics Co., Ltd.

Extended European Search Report dated Jun. 4, 2021, in corresponding European Patent Application No. 21169392.4.

* cited by examiner

WASHING MACHINE AND METHOD OF CONTROLLING THE SAME

CROSS-REFERENCE TO RELATED APPLICATIONS

This application is a Continuation Application of U.S. patent application Ser. No. 15/151,258 filed on May 10, 2016, which claims the benefit of U.S. Provisional Application 62/159,664, filed on May 11, 2015, and Korean Patent Application No. 10-2016-0051475, filed on Apr. 27, 2016 in the Korean Intellectual Property Office, the disclosures of which are incorporated herein by reference.

BACKGROUND

1. Field

Embodiments of the present disclosure relate to a washing machine which removes contaminants from laundry and a method of controlling the same.

2. Description of the Related Art

Generally, an operation of removing contaminants attached to laundry is referred to as washing and an apparatus which performs a washing operation is referred to as a washing machine.

Since attraction acts between contaminants and laundry, it is difficult to remove the contaminants from the laundry. Accordingly, in order to separate contaminants from laundry, a washing machine may supply a wash liquid which includes water and a detergent to laundry. The detergent may help contaminants easily be removed from the laundry.

Also, a large amount of time is consumed to remove contaminants due to a low diffusion speed of contaminants. Accordingly, to increase the diffusion speed of contaminants, a washing machine may heat washing water. Since ions in the washing water and contaminants are activated when a temperature of the washing water is increased, kinetic energy of the contaminants increases, and the contaminants are thereby easily separated from the laundry.

For this, the washing machine may heat the washing water using various methods and may include an additional unit which heats the washing water. For example, the washing machine may use a dielectric heating method of applying a high frequency electric field to the wash liquid to use heat loss caused by friction generated due to vibrations of ions in the detergent and polarized water molecules included in the wash liquid. Here, since the wash liquid including the detergent has a higher dielectric constant and a high loss tangent, an electric wave energy absorption rate is high and heating performance is excellent.

SUMMARY

Therefore, it is an aspect of the present disclosure to provide a washing machine which performs a washing operation by heating water, a detergent, or a wash liquid using a dielectric heating method and a method of controlling the washing machine.

Additional aspects of the present disclosure will be set forth in part in the description which follows and, in part, will be apparent from the description, or may be learned by practice of the present disclosure.

In accordance with one aspect of the present disclosure, a washing machine includes a water supply portion which supplies a wash liquid including water and a detergent, a power supply portion which supplies alternating current (AC) power, and an electric field forming portion which forms an electric field between a first electrode portion and a second electrode portion according to the AC power to heat the supplied wash liquid.

The electric field forming portion may alternately form the electric fields according to a frequency of the supplied AC power to heat the wash liquid by vibrating ions of the supplied wash liquid.

The first electrode portion and the second electrode portion of the electric field forming portion may be disposed in parallel to form an electric field in a first direction.

The first electrode portion and the second electrode portion of the electric field forming portion may be provided in planar shapes perpendicular to the first direction.

When the electric field forming portion includes a plurality of such first electrode portions and a plurality of such second electrode portions, the plurality of first electrode portions and the plurality of second electrode portions may be alternately disposed.

The first electrode portion may include a plurality of first electrodes, and the second electrode portion may include a plurality of second electrodes.

The first electrode portion may include the plurality of first electrodes arranged in a second direction perpendicular to the first direction, and the second electrode portion may include the plurality of second electrodes arranged in the second direction.

The washing machine may further include a housing which includes a washing space in which the electric field is formed, provided therein.

One of the first electrode portion and the second electrode portion of the electric field forming portion may be provided on an inner side of the housing and the other of the first electrode portion and the second electrode portion of the electric field forming portion may be provided in the washing space of the housing.

The housing may include a lifter formed of the inner side which protrudes toward a center. Here, one of the first electrode portion and the second electrode portion of the electric field forming portion may be provided on the lifter and the other of the first electrode portion and the second electrode portion of the electric field forming portion may be provided on the inner side of the housing.

The housing may include an opening which opens one side of the washing space and a door pivotably provided to open and close the opening. Here, one of the first electrode portion and the second electrode portion of the electric field forming portion may be provided on an inner side of the door and the other of the first electrode portion and the second electrode portion of the electric field forming portion may be provided on the inner side of the housing.

The first electrode portion and the second electrode portion of the electric field forming portion may be provided in pattern shapes on the inner side of the housing.

The housing may include at least one of a cabinet, a rotating tub, an auxiliary washing unit, and a drum.

The washing machine may further include a sensor portion which senses a state of at least one of the wash liquid supplied to the washing space and laundry including the wash liquid and a controller which controls the power supply portion to supply the AC power at a level corresponding to a sensing result of the sensor portion.

The sensor portion may sense at least one of a weight, a temperature, and a volume of the supplied wash liquid, and a weight, a temperature, and a volume of the laundry including the wash liquid.

The washing machine may further include an impedance matching portion which performs impedance matching based on load impedance of the laundry determined according to the sensing result of the sensor portion.

The washing machine may further include an electrode movement portion which moves the first electrode portion and the second electrode portion. Here, the controller may control the electrode movement portion to space the first electrode portion and the second electrode portion apart by a distance corresponding to the sensing result of the sensor portion.

The washing machine may further include an insulating portion which prevents the first electrode portion and the second electrode portion from coming in contact with the supplied wash liquid.

In accordance with another aspect of the present disclosure, a washing machine includes a water supply portion which supplies water, a power supply portion which supplies AC power and an electric field forming portion which forms an electric field between a first electrode portion and a second electrode portion according to the AC power to heat the supplied water.

The electric field forming portion may alternately form the electric fields according to a frequency of the supplied AC power to heat the water by vibrating ions of the supplied water.

The first electrode portion and the second electrode portion of the electric field forming portion may be disposed in parallel to form an electric field in a first direction.

The washing machine may further include a housing which includes a washing space in which the electric field is formed, provided therein.

One of the first electrode portion and the second electrode portion of the electric field forming portion may be provided on an inner side of the housing and the other of the first electrode portion and the second electrode portion of the electric field forming portion may be provided in the washing space of the housing.

The housing may include a lifter formed of the inner side which protrudes toward a center. Here, one of the first electrode portion and the second electrode portion of the electric field forming portion may be provided on the lifter and the other of the first electrode portion and the second electrode portion of the electric field forming portion may be provided on the inner side of the housing.

The housing may include an opening which opens one side of the washing space and a door pivotably provided to open and close the opening. Here, one of the first electrode portion and the second electrode portion of the electric field forming portion may be provided on an inner side of the door and the other of the first electrode portion and the second electrode portion of the electric field forming portion may be provided on the inner side of the housing.

The first electrode portion and the second electrode portion of the electric field forming portion may be provided in pattern shapes on the inner side of the housing.

In accordance with still another aspect of the present disclosure, a washing machine includes a detergent supply portion which supplies a detergent, a power supply portion which supplies AC power, and an electric field forming portion which forms an electric field between a first electrode portion and a second electrode portion according to the AC power to heat the supplied detergent.

The electric field forming portion may alternately form the electric fields according to a frequency of the supplied AC power to heat the detergent by vibrating ions of the supplied detergent.

The first electrode portion and the second electrode portion of the electric field forming portion may be disposed in parallel to form an electric field in a first direction.

The washing machine may further include a housing which includes a washing space in which the electric field is formed, provided therein.

One of the first electrode portion and the second electrode portion of the electric field forming portion may be provided on an inner side of the housing and the other of the first electrode portion and the second electrode portion of the electric field forming portion may be provided in the washing space of the housing.

The housing may include a lifter formed of the inner side which protrudes toward a center. Here, one of the first electrode portion and the second electrode portion of the electric field forming portion may be provided on the lifter and the other of the first electrode portion and the second electrode portion of the electric field forming portion may be provided on the inner side of the housing.

The housing may include an opening which opens one side of the washing space and a door pivotably provided to open and close the opening. Here, one of the first electrode portion and the second electrode portion of the electric field forming portion may be provided on an inner side of the door and the other of the first electrode portion and the second electrode portion of the electric field forming portion may be provided on the inner side of the housing.

The first electrode portion and the second electrode portion of the electric field forming portion may be provided in pattern shapes on the inner side of the housing.

In accordance with one aspect of the present disclosure, a method of controlling a washing machine which forms an electric field in a washing space in a housing using a first electrode portion and a second electrode portion. The method includes supplying a wash liquid including water and a detergent to the washing space, sensing a state of at least one of the supplied wash liquid and laundry including the wash liquid, and forming the electric field in the washing space by supplying AC power at a level corresponding to a sensing result to the second electrode portion.

The sensing of the state of at least one of the wash liquid and the laundry may include sensing at least one of a weight, a temperature, and a volume of the supplied wash liquid, and a weight, a temperature, and a volume of the laundry including the wash liquid.

The forming of the electric field in the washing space may include performing impedance matching based load impedance of the laundry determined according to the sensing result.

The method may further include spacing the first electrode portion and the second electrode portion to be apart by a distance corresponding to the sensing result.

The method may further include heating the wash liquid supplied to the washing space using the electric field.

The forming of the electric field in the washing space may include alternately forming the electric fields in the washing space according to a frequency of the supplied AC power, and the heating of the wash liquid supplied to the washing space may include heating the wash liquid by vibrating ions in the wash liquid according to the alternately formed electric fields.

BRIEF DESCRIPTION OF THE DRAWINGS

These and/or other aspects of the present disclosure will become apparent and more readily appreciated from the following description of the embodiments, taken in conjunction with the accompanying drawings of which.

DETAILED DESCRIPTION

Figure 1:
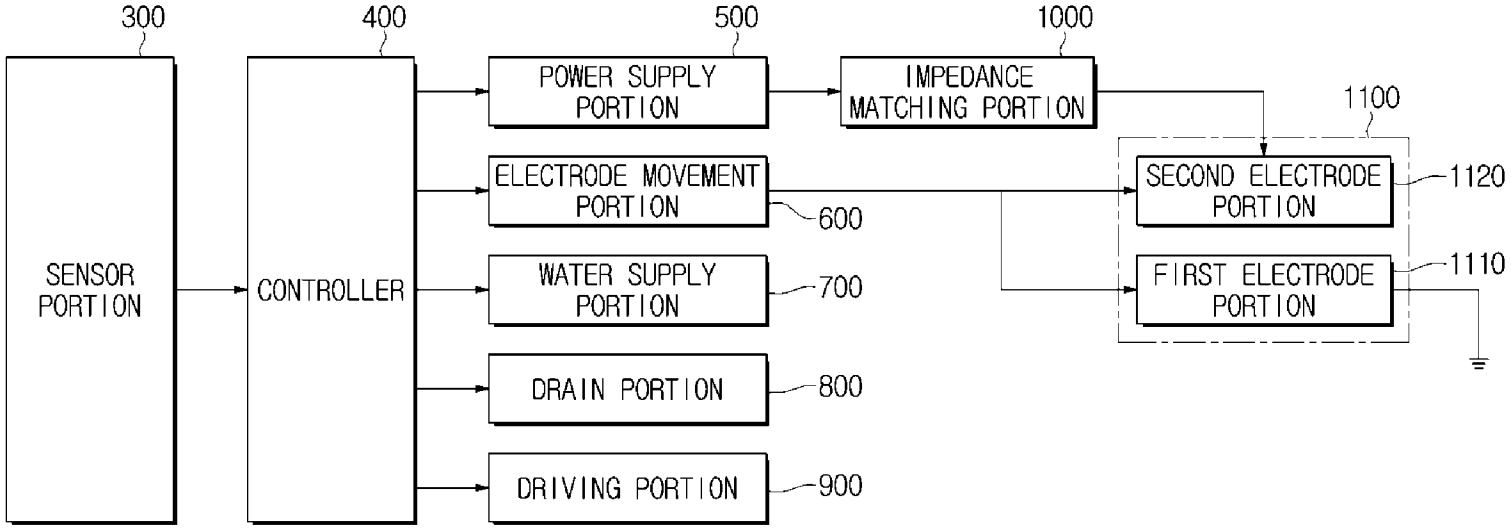
FIG. 1 is a control block diagram of a washing machine in accordance with one embodiment of the present disclosure.
Figure 3A:
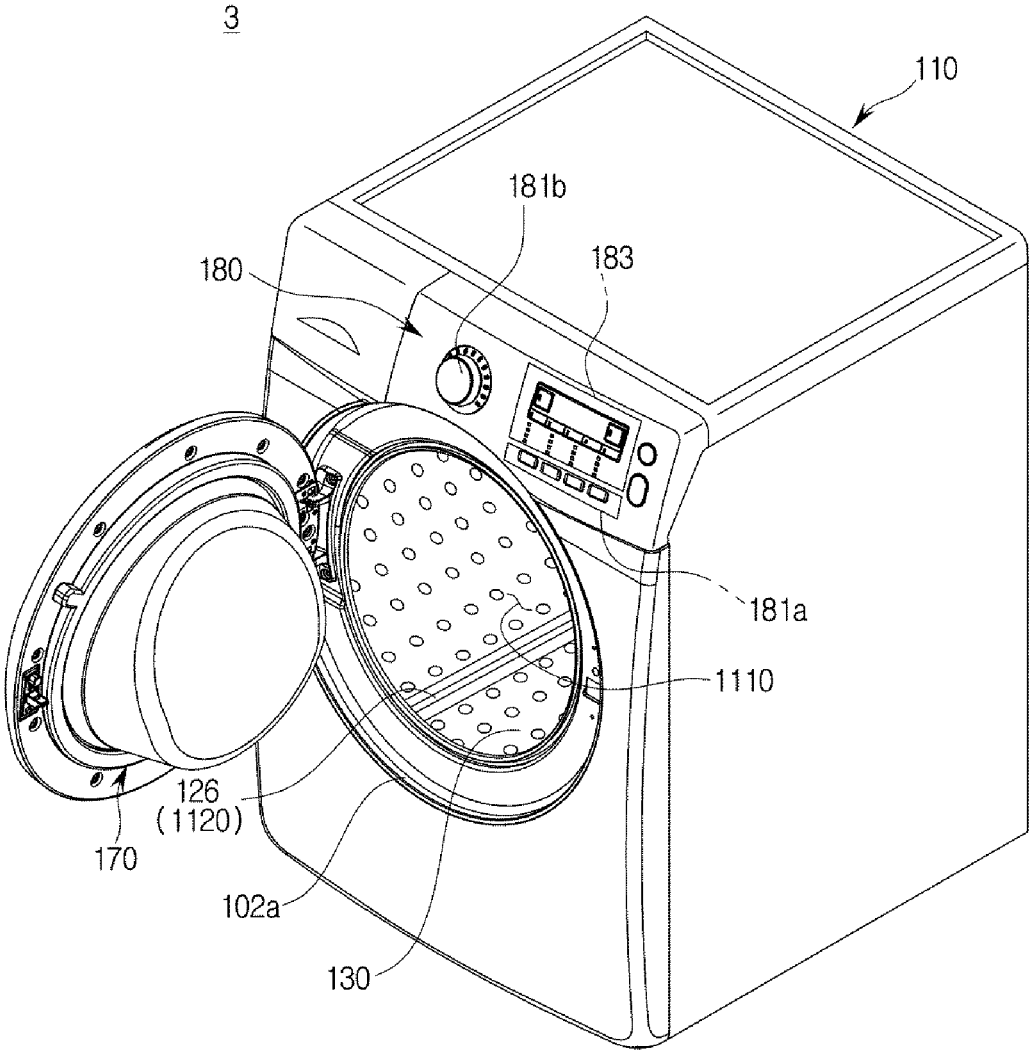
FIGS. 3A and 3B are views of a drum washing machine which employs a dielectric heating method in accordance with another embodiment of the present disclosure.
Figure 3B:
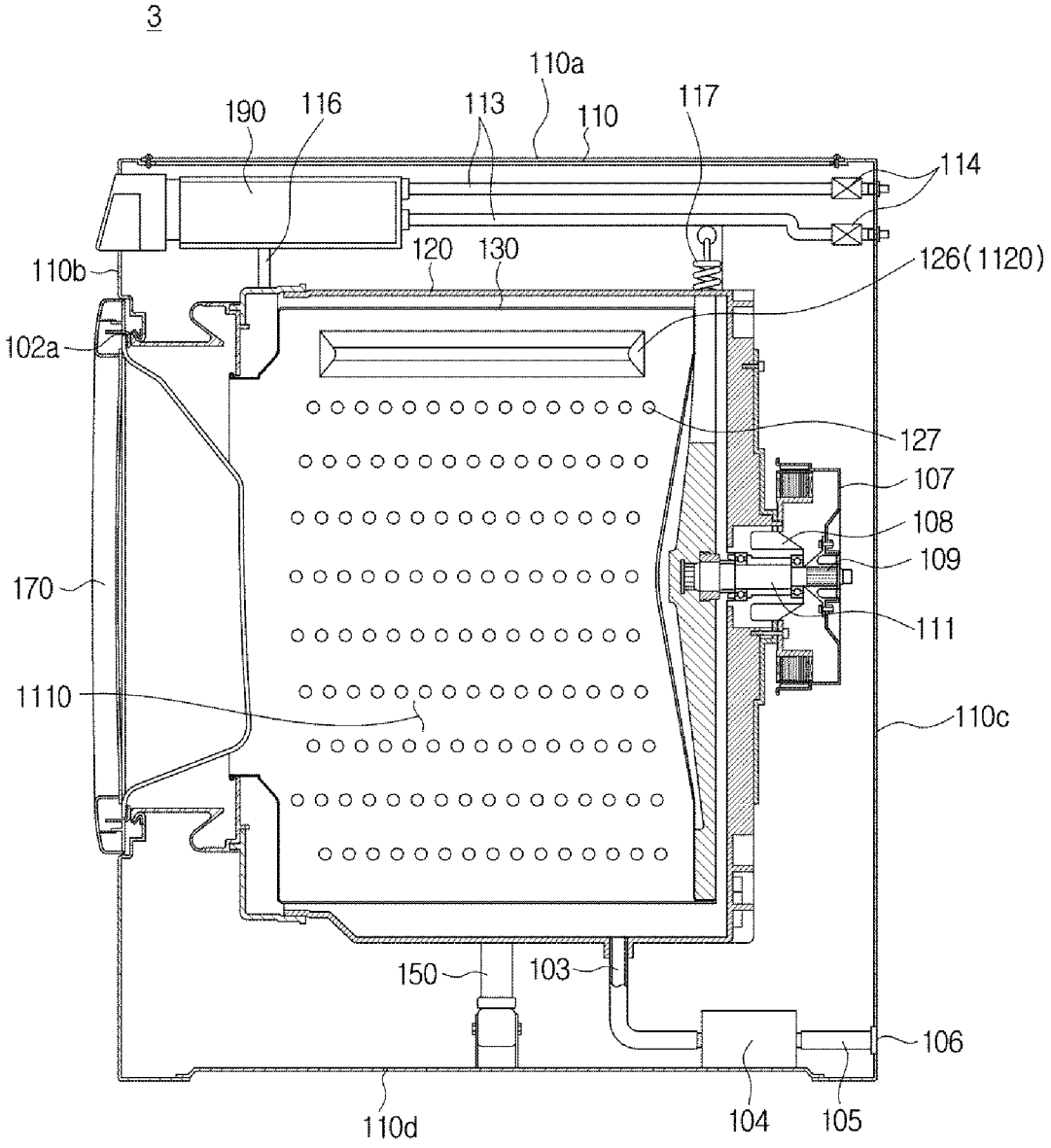
Figure 4A:
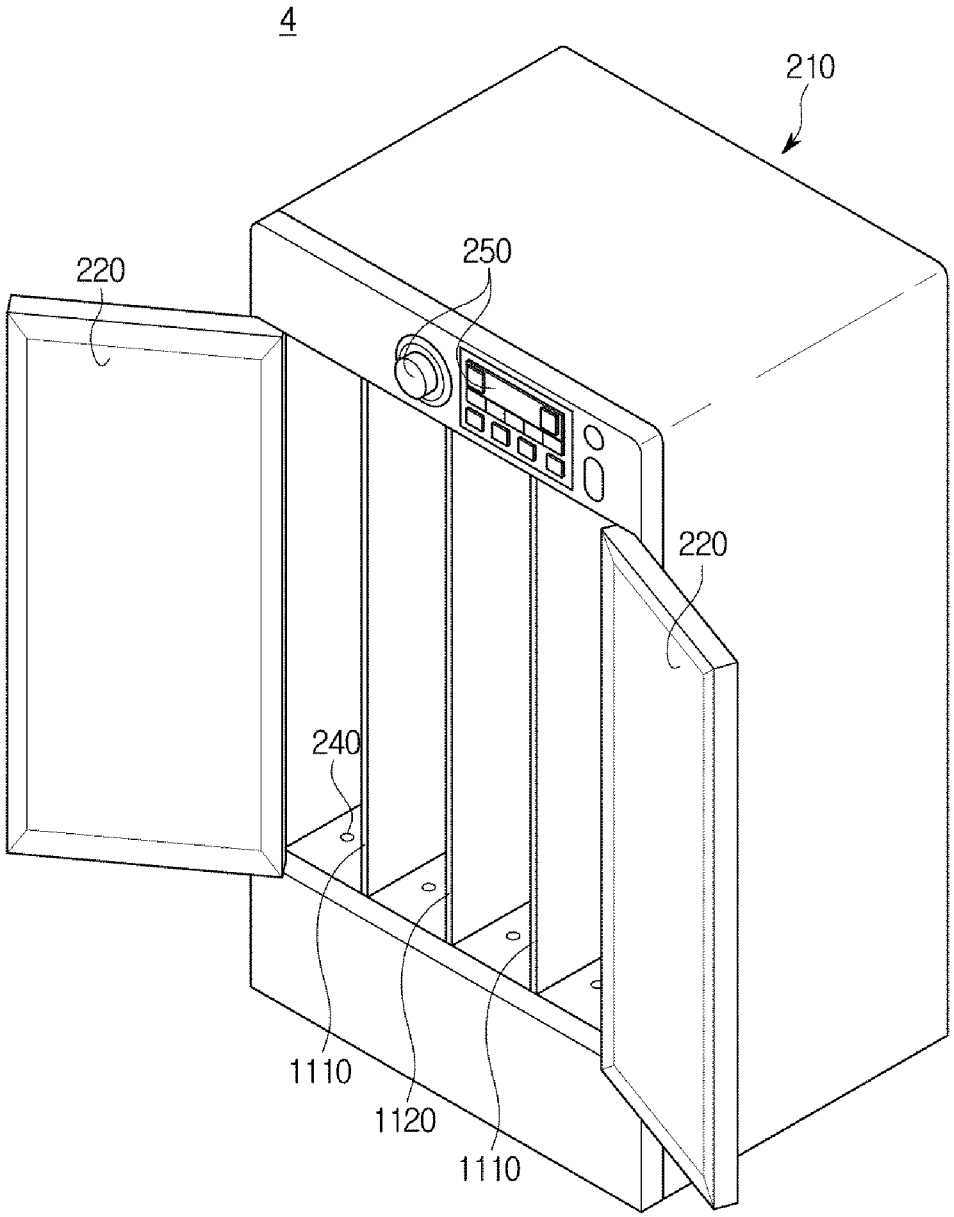
FIGS. 4A to 4C are views of a cabinet type washing machine which employs a dielectric heating method in accordance with still another embodiment of the present disclosure.
Figure 4B:
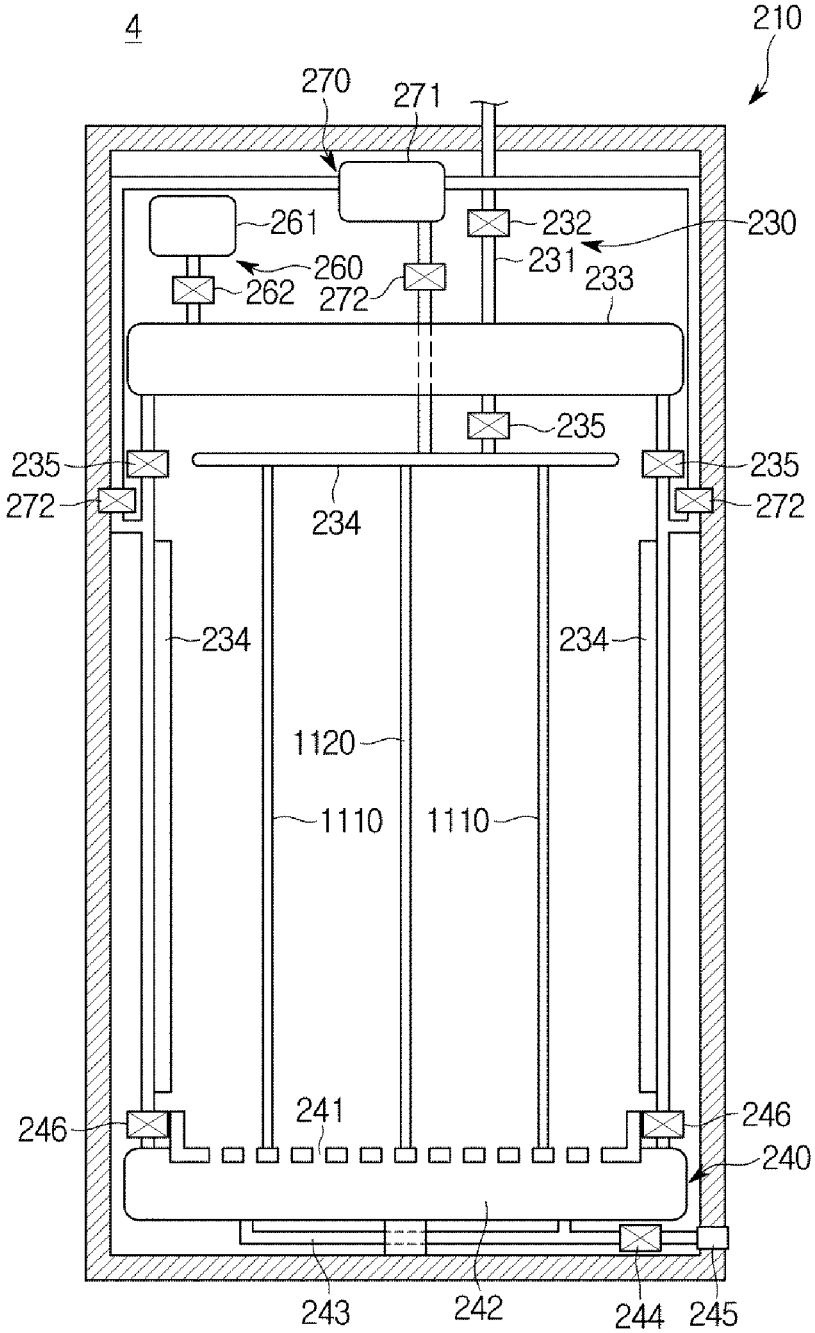
Figure 4C:
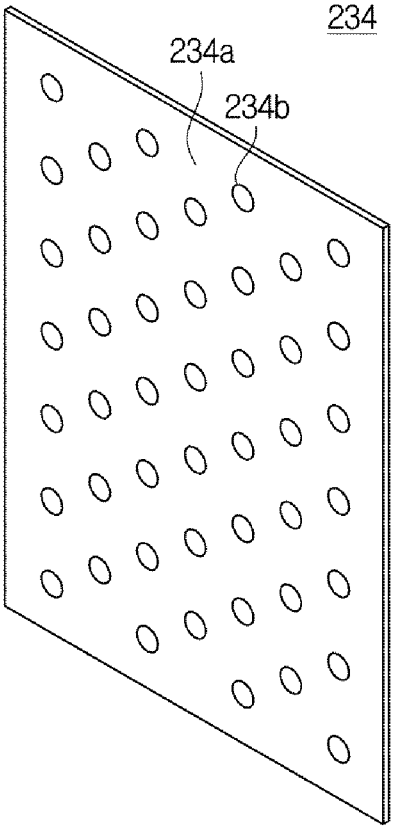
Figure 5:
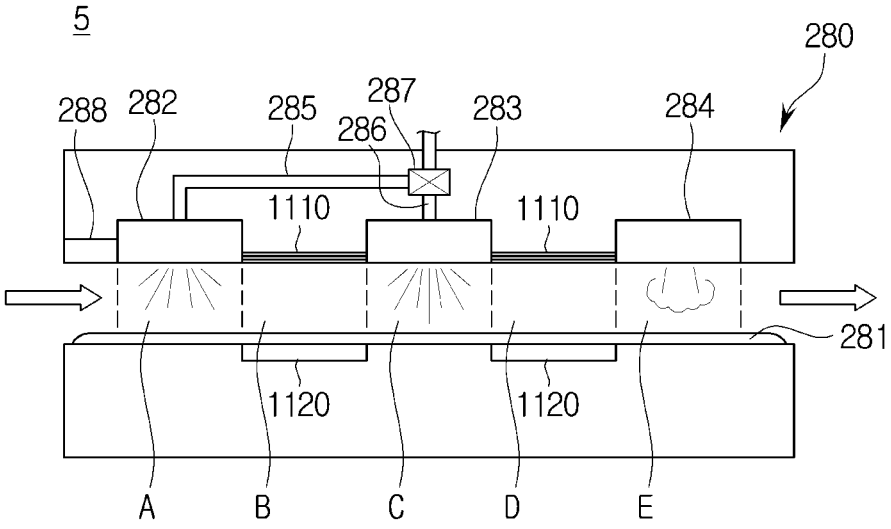
FIG. 5 is a cross-sectional view of a cabinet type washing machine which employs a dielectric heating method in accordance with yet another embodiment of the present disclosure.
Figure 6:
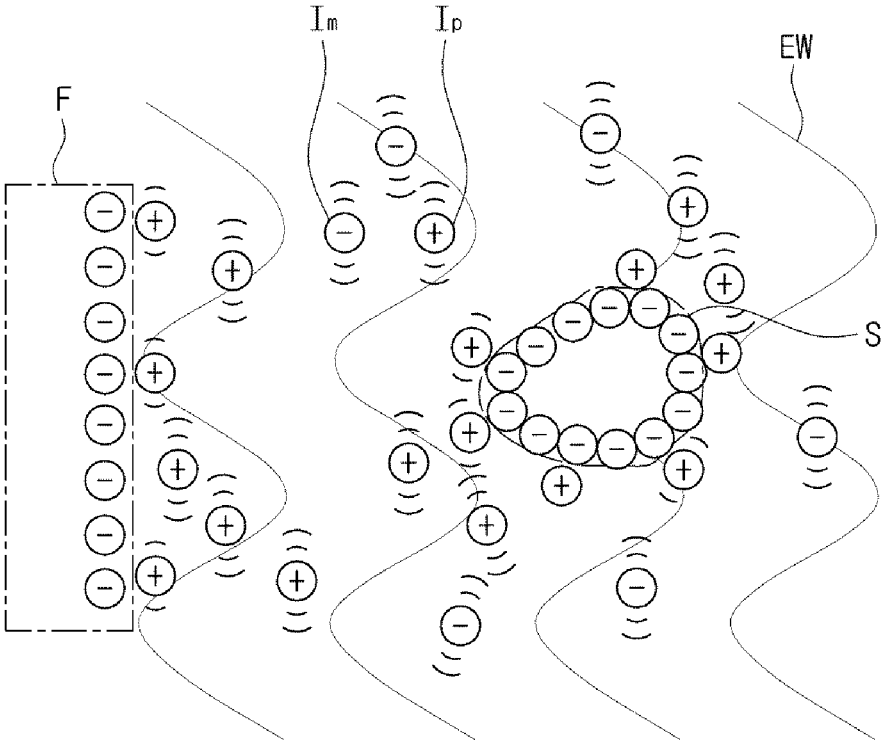
FIG. 6 is a view illustrating a washing method using a dielectric heating method.

Hereinafter, one embodiment of the present disclosure will be described in detail with reference to the attached drawings. Throughout the attached drawings, like reference numerals or symbols may refer to components or elements performing substantially like functions, FIG. 1 is a control block diagram of a washing machine in accordance with one embodiment of the present disclosure. FIGS. 2A to 2D are views of fully automatic washing machines which employ a dielectric heating method in accordance with one embodiment of the present disclosure. FIGS. 3A and 3B are views of a drum washing machine which employs a dielectric heating method in accordance with another embodiment of the present disclosure. FIGS. 4A to 4C are views of a cabinet type washing machine which employs a dielectric heating method in accordance with still another embodiment of the present disclosure, FIG. 5 is a cross-sectional view of a cabinet type washing machine which employs a dielectric heating method in accordance with yet another embodiment of the present disclosure. Also, FIG. 6 is a view illustrating a washing method using a dielectric heating method. Washing means a series of processes of removing contaminants attached to laundry, and an apparatus for performing a washing operation described above is referred to as a washing machine. Washing machines may be classified according to a shape and a method of performing a washing operation. Hereinafter, referring to FIGS. 2A to 5, washing machines in accordance with several embodiments of the present disclosure will be described.

FIGS. 2A to 2D illustrate a case in which washing machines 1 and 2 are provided in the form of fully automatic washing machines.

Figure 2A:
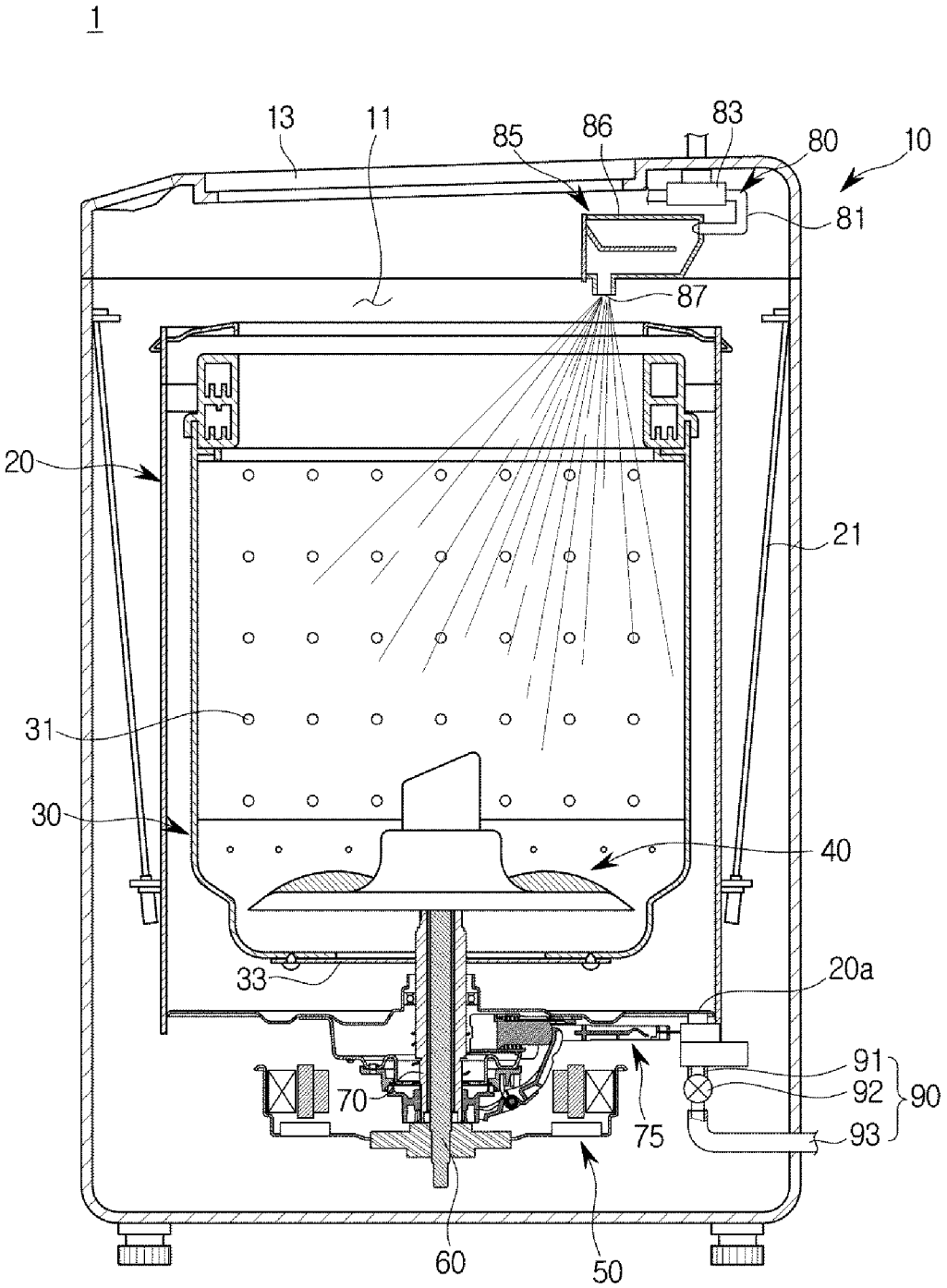
FIGS. 2A to 2D are views of fully automatic washing machines which employ a dielectric heating method in accordance with one embodiment of the present disclosure.

Referring to FIG. 2A, the washing machine 1 in accordance with one embodiment of the present disclosure includes a cabinet 10 which forms an exterior, a water tub 20 provided in the cabinet 10 to contain water, a rotating tub 30 which is rotatably disposed in the water tub and accommodates laundry, a pulsator 40 which is rotatably provided on a bottom in the rotating tub 30 and generates water currents, a main motor 50 which is disposed below the rotating tub 30 and rotates the rotating tub 30 and the pulsator 40, and a clutch 75 which is provided below the rotating tub 30 and selectively transfer torque generated by the main motor 50 to the rotating tub 30.

A laundry insertion opening 11 may be formed above the cabinet 10 for inserting laundry into the rotating tub 30, and a door 13 for opening and closing the laundry insertion opening 11 may be provided.

The water tub 20 may be formed in a cylindrical shape with an open top and may contain water, a detergent, or a combination thereof therein. Also, the water tub 20 may be supported while being held by the cabinet 10 by a suspending apparatus 21. The suspending apparatus 21 is disposed between an inner surface of the cabinet 10 and an outer surface of the water tub 20 to reduce vibrations generated by the cabinet 10 or the water tub 20 during washing or spin-drying.

The rotating tub 30 may be provided with an open top for inserting laundry thereinto and is rotatably disposed in the water tub 20. A plurality of through holes 31 may be provided at a side of the rotating tub 30 to allow washing water to pass inside and outside of the rotating tub 30. A flange shaft 33 which is connected to the main motor 50 and transfers the torque of the main motor 50 to the rotating tub 30 may be coupled with a bottom of the rotating tub 30.

The pulsator 40 is rotatably installed at the bottom in the rotating tub 30 to agitate the laundry inserted into the rotating tub 30 with the water, the detergent, or the combination thereof. Since the pulsator 40 may be connected to the main motor 50 by a washing shaft 60 and the torque generated by the main motor 50 may be transferred to the washing shaft 60, when the washing shaft 60 rotates, the pulsator 40 may rotate together with the washing shaft 60 counterclockwise or clockwise. When water currents are generated by rotation of the pulsator 40, the laundry in the rotating tub 30 may be agitated with the water, the detergent, or the combination thereof and washing may be performed by friction between the laundry and the water, the detergent, or the combination thereof. When the rotating tub 30 is connected to the main motor 50 by a spin-drying shaft 70 and the torque generated by the main motor 50 is transferred to the spin-drying shaft 70 in such a way that the spin-drying shaft 70 rotates, the rotating tub 30 may rotate together with the spin-drying shaft 70 counterclockwise or clockwise.

A water supply portion 80 is provided above the water tub 20 and supplies water into the water tub 20 from an external water source. The water supply portion 80 includes a water supply pipe 81 which guides the water to the water tub 20 from the external water source and a water supply valve 83 provided at the water supply pipe 81 to open and close the water supply pipe 81.

One end of the water supply pipe 81 may be connected to a detergent supply portion 85. The water supplied through the water supply pipe 81 may pass through the detergent supply portion 85 and may flow into the water tub 20.

The detergent supply portion 85 may include a detergent box 86 which contains a detergent, and the detergent box 86 may be connected to one end of the water supply pipe 81. The water supplied through the water supply portion 80 may be mixed with the detergent while passing through the detergent box 86 and the water mixed with the detergent may be discharged into the water tub 20 through an outlet 87 provided at a bottom side of the detergent box 86. Hereinafter, the water which passes through the detergent supply portion 85 and is mixed with the detergent will be referred to as a wash liquid.

A drainage portion 90 may be provided below the water tub 20 and discharges the water contained in the water tub 20 outward from the cabinet 10. The drainage portion 90 may include a first drainpipe 91 which guides the water contained in the water tub 20 outward from the water tub 20, a drain valve 92 which opens and closes the first drainpipe 91, and a second drainpipe 93 which guides the water passing through the drain valve 92 outward.

One end of the first drainpipe 91 may be connected to a drainage hole 20*a* provided in the bottom side of the water tub 20 and another end thereof may be connected to the drain valve 92.

The drain valve 92 is provided at one end of the first drainpipe 91 and opens and closes the first drainpipe 91. When the drain valve 92 is opened, the water in the water tub 20 may be discharged outward through the first drainpipe 91 and the second drainpipe 93.

One end of the second drainpipe 93 may be connected to the drain valve 92 and another end thereof may extend outward from the cabinet 10 to guide the water discharged through the first drainpipe 91 to the outside of the cabinet 10.

Figure 2B:
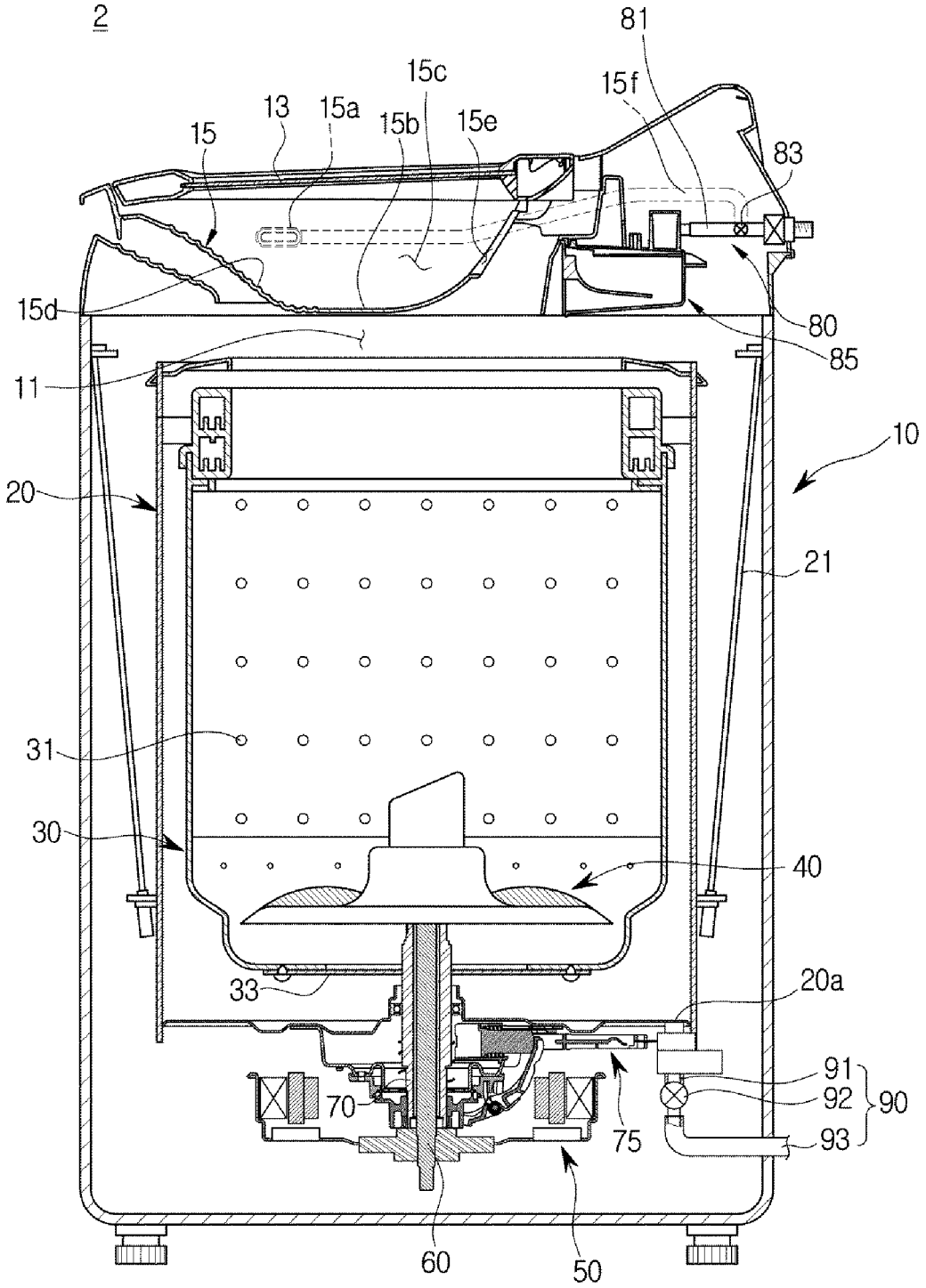

Meanwhile, a fully automatic washing machine may further include a component which forms an additional washing space other than a washing space formed by a water tub. Referring to FIG. 2B, the washing machine 2 in accordance with another embodiment of the present disclosure may further include an auxiliary washing unit 15 which provides a washing space for performing simple washing such as hand-washing.

The auxiliary washing unit 15 may form the washing space through a bottom portion 15*b* and a side portion 15*c*. The bottom portion 15*b* is an element which determines a depth of the auxiliary washing space. The bottom portion 15*b* may be formed flat or curved. The side portion 15*c* is formed to have a gradient toward the bottom portion 15*b*.

The bottom portion 15*b* and the side portion 15*c* are provided to have an approximately concave washing space to receive the water, the detergent, or the wash liquid at the auxiliary washing space to perform additional washing.

The auxiliary washing unit 15 may include a frictional protrusion 15*d*. Also, the auxiliary washing unit 15 may include an auxiliary drain hole 15*e*.

The auxiliary drain hole 15*e* is provided to drain washing water used in the washing space formed by the auxiliary washing unit 15. The auxiliary drain hole 15*e* may be provided at the side portion 15*c* in a hole shape. The auxiliary drain hole 15*e* is provided to discharge the water, the detergent, or the wash liquid stored in the washing space in the auxiliary washing unit 15 slantwise when the auxiliary washing unit 15 pivots.

Also, an auxiliary water supply pipe 15*f* may be provided to supply water to the washing space formed by the auxiliary washing unit 15. One end of the auxiliary water supply pipe 15*f* may be connected to an auxiliary water supply hole 15*a* and another end thereof may be connected to the water supply valve 83.

So far, the cases in which the washing machines 1 and 2 are provided as fully automatic washing machines have been described. Hereinafter, a case in which a washing machine is provided as a drum type washing machine will be described.

Referring to FIGS. 3A and 3B, a washing machine 3 includes a cabinet 110 which forms an exterior, a tub 120 which contains water, a detergent, or a wash liquid used for a washing operation or a rinsing operation, a drum 130 which accommodates laundry, and a driving motor 107 which rotates the drum 130.

The cabinet 110 may include a control panel 180 which includes input portions 181*a* and 181*b* which receive a command for operating the washing machine 3 from a user and a display portion 183 which displays operation information of the washing machine 3.

Also, the cabinet 110 includes frames 110*a*, 110*b*, 110*c*, and 110*d*. The frames 110*a*, 110*b*, 110*c*, and 110*d* are formed of an upper frame 110*a* which forms an upper side of the cabinet 110, front and rear frames 110*b* and 110*c* which form front and rear sides of the cabinet 110, and a side frame (not shown) and a lower frame 110*d* which connect the front frame 110*b* and the rear frame 110*c* and form a side and a lower side of the cabinet 110.

An inlet hole 102*a* is formed at the front frame 110*b* of the cabinet 110 for inserting laundry into the drum 130. The inlet hole 102*a* is opened and closed by a door 170 installed at the front frame 110*b* of the cabinet 110.

A spring 117 for supporting the tub 120 from above may be provided between the tub 120 and the cabinet 110. The spring 117 reduces vibrations and noise generated by movement of the tub 120 using an elastic force.

Water supply pipes 113 for supplying the washing water to the tub 120 are installed above the tub 120. Water supply valves 114 may be installed at one side of each of the water supply pipes 113.

A detergent supply portion 190 is connected to the tub 120 through a connecting pipe 116. Water supplied through the water supply pipes 113 passes through the detergent supply portion 190 and is supplied together with a detergent into the tub 120.

The tub 120 is supported by a damper 150. The damper 150 connects an inner bottom surface of the cabinet 110 with an outer surface of the tub 20. Also, the damper 150 may support the tub 120 while positioned at an upper side, a left side, or a right side other than the inner bottom surface of the cabinet 110. The damper 150 or the spring 117 may reduce vibrations and shocks generated due to vertical movement of the tub 120 above and below the tub 120.

The tub 120 may be supported by at least one of such dampers 150.

A driving shaft 111 for transferring power of the driving motor 107 is connected to a rear side of the drum 130. A plurality of through holes 127 for allowing water, a detergent, or a wash liquid to pass therethrough are formed on a perimeter of the drum 130. A plurality of lifters 126 are installed on an inner circumferential surface of the drum 130 to allow laundry to move upward and downward while the drum 130 rotates.

The driving shaft 111 is disposed between the drum 130 and the driving motor 107. One end of the driving shaft 111 is connected a rear plate of the drum 130 and another end thereof extends outward from a rear wall of the tub 120. When the driving motor 107 drives the driving shaft 111, the drum 130 connected to the driving shaft 111 may rotate around the driving shaft 111.

A bearing housing 108 is installed on the rear wall of the tub 120 to rotatably support the driving shaft 111. The bearing housing 108 may be formed of an aluminum alloy and may be inserted into the rear wall of the tub 120 when the tub 120 is injection-molded. Bearings 109 may be installed between the bearing housing 108 and the driving shaft 111 to allow the driving shaft 111 to smoothly rotate.

Below the tub 120, a drain pump 104 for draining the water, the detergent, or the wash liquid in the tub 120 outward from the cabinet 110, a connecting hose 103 which connects the tub 120 with the drain pump 104 to allow the water, the detergent, or the wash liquid in the tub 120 to flow into the drain pump 104, and a drain hose 105 which guides the water, the detergent, or the wash liquid pumped by the drain pump 104 outward from the cabinet 110.

The drain hose 105 extends to a rear side of the cabinet 110 through a through hole installed in the rear frame 110*c* of the cabinet 110. The drain hose 105 which extends to the rear side of the cabinet 110 is fixed to an outer circumferential surface of the rear frame 110*c* by a holder 106.

In addition to the embodiments described above, various modifications of washing machines are possible within the technical concept of removing contaminants from laundry. For example, a washing machine may be provided to perform a washing operation by spraying water, a detergent, or a wash liquid on laundry loaded in a washing space therein.

Referring to FIGS. 4A to 4C, a washing machine 4 in accordance with still another embodiment of the present disclosure may include a cabinet 210 which forms an exterior and forms a washing space therein, a door 220 which opens and closes one side of the cabinet 210, a water supply portion 230 which supplies water through an upper side of an inside of the cabinet 210, a drain portion 240 which drains washing water through a lower side of the inside of the cabinet 210, a control panel 250 which receives a control command from a user, a detergent supply portion 260 which supplies a detergent to the water supply portion 230, a spin-drying portion 270 which provides compressed air for spin-drying.

Laundry may be loaded in the washing space formed in the cabinet 210. For this, the cabinet 210 may further include a loading unit which fixes the laundry totally or partially.

One side of the cabinet 210 may be opened, and the laundry may be inserted into the cabinet 210 through the opened one side. The door 220 may open the one side of the cabinet 210 when the laundry is inserted and may close the one side of the cabinet 210 when a washing operation is performed. Even though FIG. 4A illustrates a case in which two doors are pivotably installed at the opened one side of the cabinet 210, the one side of the cabinet 210 may be opened and closed using a single door or may be opened and closed using a sliding door.

The water supply portion 230 may be installed on the upper side of the inside of the cabinet 210 and may supply water to laundry loaded therebelow. For this, the water supply portion 230 may include a water supply pipe 231 which guides water from an external water source, a water supply valve 232 provided at the water supply pipe 231 to open and close the water supply pipe 231, a first water storage portion 233 which is connected to one of the water supply pipe 231 and temporarily stores water, a plurality of jet portions 234 which jet stored washing water toward laundry, and a jet valve 235 which transfers a jet force to water, a detergent, or a wash liquid stored in the first water storage portion 233 to jet the stored water, detergent, or wash liquid through the plurality of jet portions 234.

Referring to FIG. 4C, each of the jet portions 234 may include a jet side 234*a* and a plurality of jet nozzles 234*b* provided at the jet side 234*a*. Here, the jet side 234*a* may be embodied as a first electrode portion 1110 or a second electrode portion 1120 capable of forming an electric field, which will be described below.

The detergent supply portion 260 may supply a detergent to the first water storage portion 233. For this, the detergent supply portion 260 may include a detergent storage portion 261 which stores a detergent and a detergent jet valve 262 which determines whether to supply the detergent. As a result, the water temporarily stored in the first water storage portion 233 is mixed with the detergent, thereby supplying a wash liquid to laundry.

The drain portion 240 may be installed at the lower side of the inside of the cabinet 210 and may drain water, a detergent, or a wash liquid used for washing laundry loaded above outward. For this, the drain portion 240 may include an absorption portion 241 which absorbs water, a detergent, or a wash liquid used for a washing operation, a second water storage portion 242 which temporarily stores the absorbed water, detergent, or wash liquid, a drain pipe 243 which guides the water, the detergent, or the wash liquid stored in the second water storage portion 242, a drain valve 244 which opens and closes the drain pipe 243, and a holder 245 which fixes one end of the drain pipe 243 to the cabinet 210.

The cabinet 210 may include a control panel 250 which includes input portions which receive a command for operating the washing machine 4 from a user and a display portion which displays operation information of the washing machine 4.

Also, the spin-drying portion 270 may jet compressed air toward laundry to separate water, a detergent, or a wash liquid from the laundry. For this, the spin-drying portion 270 may include a compressed air storage portion 271 which stores the compressed air and a compressed air jet valve 272 which determines whether to jet the compressed air.

Also, the washing machine 4 may further include an additional unit which applies a mechanical force to laundry to separate contaminants from the laundry. For example, the washing machine 4 may include a pressurizing unit which periodically or aperiodically applies a pressure to laundry and/or a rotating unit which periodically or aperiodically rotates laundry.

A washing machine in accordance with yet another embodiment of the present disclosure may be embodied to transfer laundry in a predetermined direction and to perform a washing operation corresponding to a position of the laundry.

Referring to FIG. 5, a washing machine 5 in accordance with yet another embodiment of the present disclosure may include a cabinet 280 which forms an exterior into or from which laundry can be inserted or withdrawn, a conveying belt 281 which conveys laundry, a first water supply portion 282 which supplies a wash liquid including water and a detergent to laundry positioned at a first section A, a second water supply portion 283 which supplies water to laundry positioned at a second section C, a spin-drying portion 284 which supplies air for spin-drying to laundry positioned at a third section E, a first pipe 285 which transfers water supplied from an outside to the first water supply portion 282, a second pipe 286 which transfers the water supplied from the outside to the second water supply portion 283, a valve 287 which controls the water transferred to the first pipe 285 and the second pipe 286, and a detergent supply portion 288 which supplies a detergent to the first water supply portion 282.

The cabinet 280 may include a laundry inlet hole for inserting laundry and a laundry outlet hole provided opposite the laundry inlet hole at one side therein and an internal washing space which connects the laundry inlet hole with the laundry outlet hole.

The conveying belt 281 may convey laundry in a direction of an arrow. In FIG. 5, the conveying belt 281 may discharge laundry inserted from a left side to a right side, and all operations for washing may be performed by the time the laundry inserted into the washing machine 5 is discharged.

The first water supply portion 282 may provide the wash liquid to the laundry positioned at the first section A. When the laundry conveyed by the conveying belt 281 is positioned at the first section A, the first water supply portion 282 located above the first section A may jet the wash liquid downward. Through this, the washing machine 5 may perform a washing operation.

The second water supply portion 283 may provide the wash liquid to the laundry positioned at the second section C. When the laundry conveyed by the conveying belt 281 is positioned at the second section C, the second water supply portion 283 located above the second section C may jet the wash liquid downward. As described above, the laundry may include the wash liquid through the washing operation in the first section A. Accordingly, the laundry positioned at the second section C may be rinsed by the water supplied from the second water supply portion 283. Through this, the washing machine 5 may perform a rinsing operation.

The spin-drying portion 284 may supply compressed air to laundry positioned at the third section E. When the laundry conveyed by the conveying belt 281 is positioned at the third section E, the spin-drying portion 284 located above the third section E may jet the compressed air downward. As described above, the laundry is rinsed through the rinsing operation in the second section C, thereby including water from which the detergent is removed. Accordingly, the water may be removed from the laundry positioned at the third section E by the compressed air supplied from the spin-drying portion 284. Through this, the washing machine 5 may perform a spin-drying operation.

The washing machines of FIGS. 2A to 5 described above may heat water, a detergent, or a wash liquid supplied to laundry according to a dielectric heating method to increase efficiency in a washing operation. As shown in FIG. 6, when a wash liquid is supplied to laundry, a detergent is present as ions in the wash liquid. Accordingly, the wash liquid may include a plurality of cations Ip and a plurality of anions Im.

When the wash liquid is supplied, surfaces of laundry F and contaminants S are negatively charged. Here, ions of the detergent may penetrate through the surfaces of the laundry F and contaminants S, particularly, a coupled space between the laundry F and the contaminants S and may be adsorbed and arranged. As a result thereof, a binding force between the laundry F and the contaminants S may be weakened and the contaminants S may be easily separated from the laundry F due to an electric repulsive force of the adsorbed and arranged ions. When a washing operation is performed using washing water including a detergent, the washing machine may heat a wash liquid to remove contaminants S from laundry F. For this, the washing machine applies an electric field EW to the wash liquid to cause movement of polarized water molecules and ions of the detergent included in the wash liquid. According to a heat loss generated by the movement described above, a chemical reaction between the detergent and the contaminants S may be catalyzed, and washing performance may be ultimately improved.

So far, only the wash liquid has been described but the wash liquid may be replaced by water or a detergent.

Hereinafter, a washing machine which heats water, a detergent, or a wash liquid using a dielectric heating method will be described in detail.

As described above, the washing machine may heat washing water supplied to a heating space using the dielectric heating method. Here, dielectric heating refers to heating a dielectric through friction of molecules which form the dielectric by applying a high frequency electric field to a space between the electrodes.

Referring to FIG. 1, a washing machine in accordance with one embodiment of the present disclosure may include an electric field forming portion 1100 which includes the first electrode portion 1110 which is grounded and the second electrode portion 1120 which is spaced apart from the first electrode portion 1110 and forms a heating space W, a power supply portion 500 which supplies alternating current (AC) power to the second electrode portion 1120 to form an electric field in the heating space W, an electrode movement portion 600 which adjusts a distance between the first electrode portion 1110 and the second electrode portion 1120, a sensor portion 300 which senses states of laundry accommodated in the heating space W, or supplied water, detergent, or wash liquid, a controller 400 which controls the power supply portion 500 to supply power with a level corresponding to a sensing result to the second electrode portion 1120 and controls the electrode movement portion 600 to space the first electrode portion 1110 and the second electrode portion 1120 apart at a distance corresponding to the sensing result, an impedance matching portion 1000 which performs impedance matching based on load impedance of laundry, a water supply portion 700 which supplies water, a detergent, or a wash liquid to a washing space, a drain portion 800 which drains water, a detergent, or a wash liquid used for washing outward, and a driving portion 900 which applies a mechanical force to laundry.

The water supply portion 700 including a detergent supply portion and the drain portion 800 for performing water supply or water drainage with respect to the washing space including the heating space W under the control of the controller 400 as described above with reference to FIGS. 2A to 5. Also, the driving portion 900 is a component which generates a mechanical force for removing contaminants from the laundry accommodated in the heating space W under the control of the controller 400 and may be embodied as the main motor 50 in FIGS. 2A and 2B and the driving motor 107 in FIGS. 3A and 3B.

The electric field forming portion 1100 may include the first electrode portion 1110 and the second electrode portion 1120 formed to be spaced apart. The heating space W for heating washing water may be formed between the first electrode portion 1110 and the second electrode portion 1120.

The electric field forming portion 1100 may be provided in a washing space inside a housing. Here, the housing may be embodied as at least one of the rotating tub 30 of FIG. 2A, the rotating tub 30 and the auxiliary washing space of FIG. 2B, the drum 130 of FIGS. 3A and 3B, the cabinet 210 of FIGS. 4A to 4C, and the cabinet 280 of FIG. 5.

The electric field forming portion 1100 may be installed in each of the washing machines of FIGS. 2A to 5 using various methods.

In accordance with one embodiment of the present disclosure, the washing machines 1 and 2 of FIGS. 2A to 2D may each include the pulsator 40 including the first electrode portion 1110 and the second electrode portion 1120.

Figure 2C:
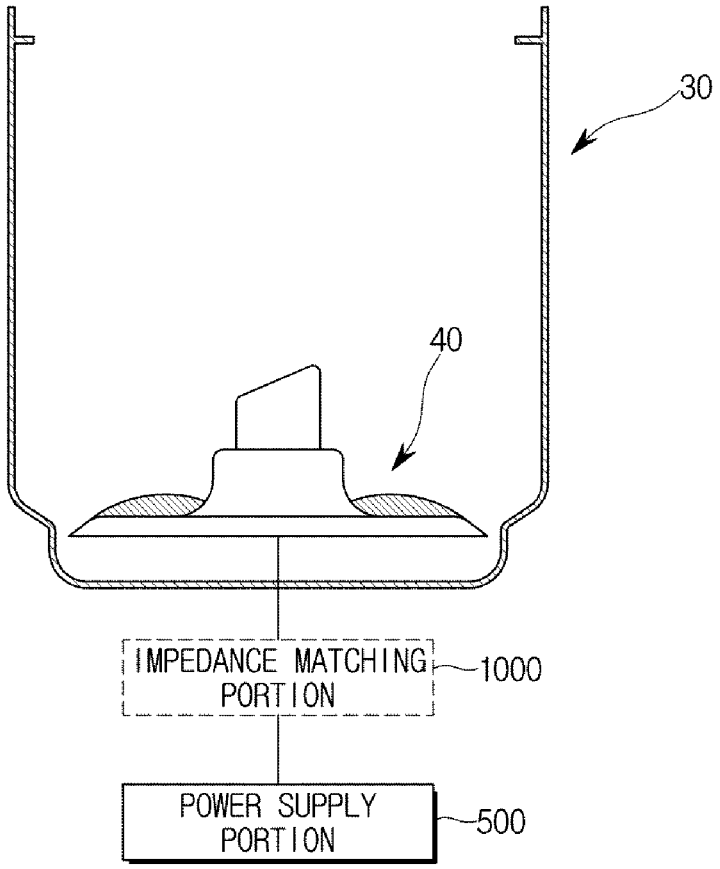
Figure 2D:
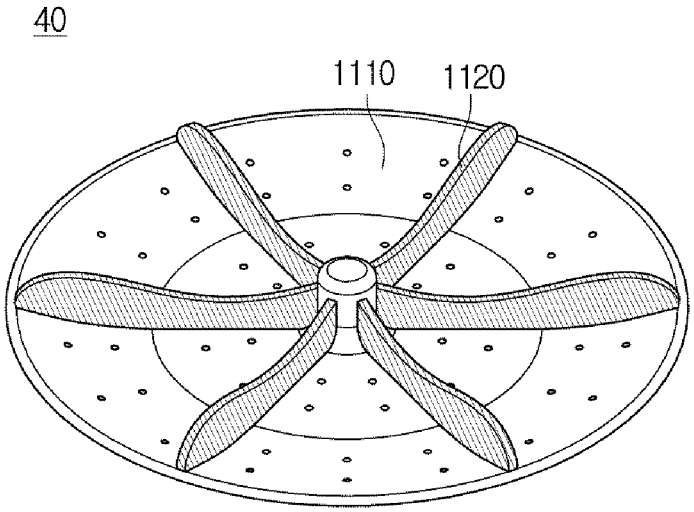

Referring to FIGS. 2C and 2D, the pulsator 40 may be connected to the power supply portion 500 directly or through the impedance matching portion 1000. When power is supplied from the power supply portion 500, the first electrode portion 1110 and the second electrode portion 1120 provided at the pulsator 40 may form an electric field.

Referring to FIG. 2D, a plurality of vanes of the pulsator 40 may be formed as the second electrode portion 1120 and a bottom area of the pulsator 40 may be formed as the first electrode portion 1110. However, this is merely an example of the pulsator 40 including the first electrode portion 1110 and the second electrode portion 1120 and it is not limited thereto. Hereinafter, referring to FIG. 7, another example of the pulsator 40 including the first electrode portion 1110 and the second electrode portion 1120 will be described.

Figure 7:
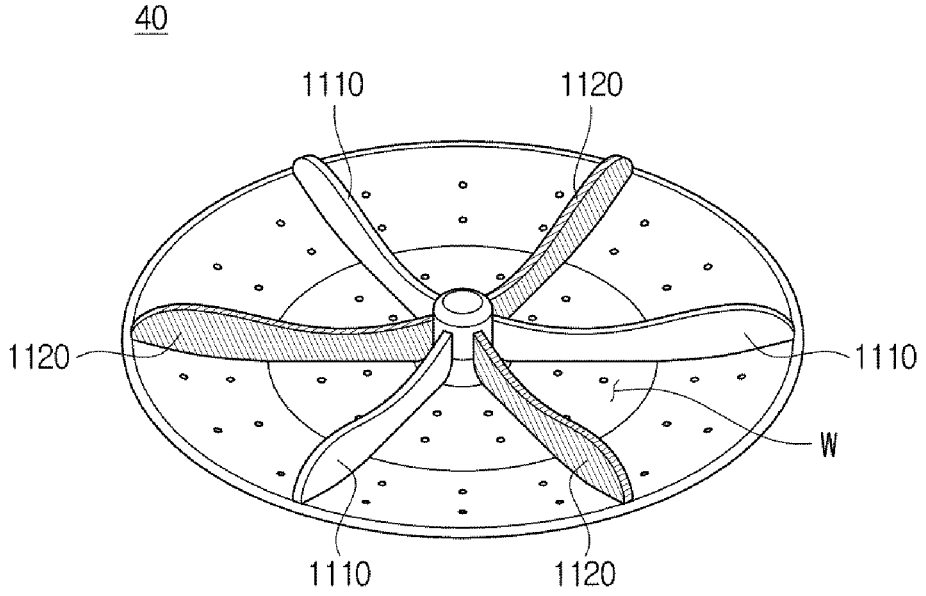
FIG. 7 is a perspective view of a pulsator of the washing machine of FIGS. 2A and 2B.

FIG. 7 is a perspective view of a pulsator of the washing machine of FIGS. 2A and 2B.

Referring to FIG. 7, each of the plurality of vanes of the pulsator 40 may include the first electrode portion 1110 or the second electrode portion 1120. In detail, the plurality of vanes of the pulsator 40 may be configured to alternately include the first electrode portions 1110 and the second electrode portions 1120. As a result thereof, a space between adjacent vanes of the pulsator 40 may be the heating space W where an electric field is formed.

Also, the washing machine 3 of FIGS. 3A and 3B may include a lifter including one of the first electrode portion 1110 and the second electrode portion 1120.

Figure 8:
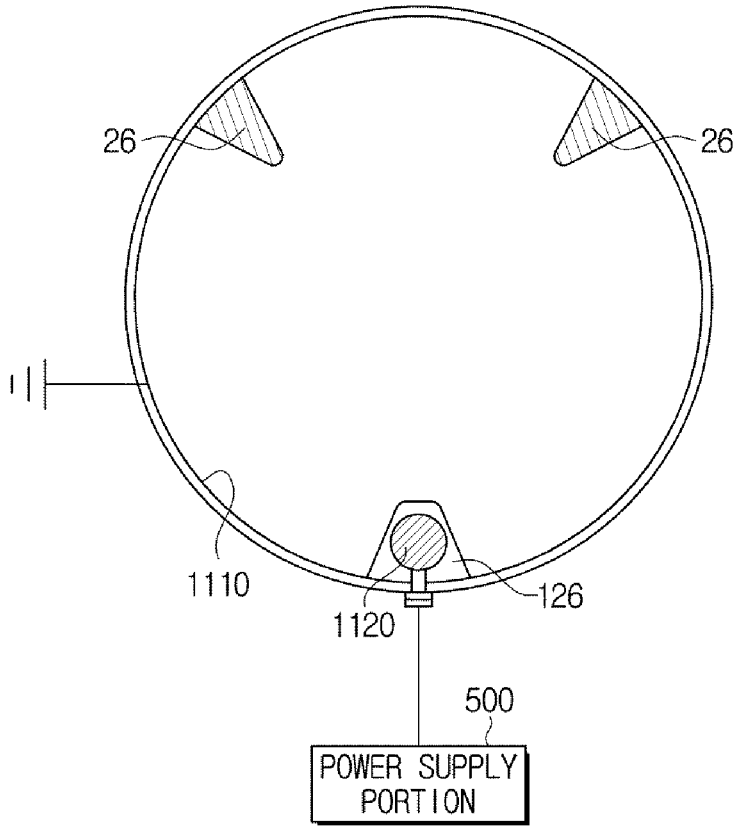
FIG. 8 is a cross-sectional view of a drum of the washing machine of FIGS. 3A and 3B.

FIG. 8 is a cross-sectional view of a drum of the washing machine of FIGS. 3A and 3B.

As described above, a plurality of lifters 126 for moving laundry upward and downward while the drum 130 rotates may be provided on an inner side of the drum 130. Here, the plurality of lifters 126 may be totally or partially formed to include the first electrode portion 1110 or the second electrode portion 1120. FIG. 8 illustrates a case in which the second electrode portion 1120 is included in one of three lifters 126 provided on the inner side of the drum 130. Here, the first electrode portion 1110 may be formed throughout or at a part of an area of the inner side of the drum 130 except a part where the lifters 126 are formed. As a result thereof, the heating space W where an electric field is formed may be formed between the lifter 126 including the second electrode portion 1120 and the inner side of the drum 130 in the washing space in the drum 130.

Since a position of the lifter 126 changes according to rotation of the drum 130, the second electrode portion 1120 in the lifter 126 may be provided to be connected to the power supply portion 500 which will be described when the lifter 126 arrives at a predetermined position. For example, when the drum 130 rotates and the lifter 126 including the second electrode portion 1120 is located below, the second electrode portion 1120 may be electrically connected to the power supply portion 500 and may receive AC power. As a result thereof, when the lifter 126 including the second electrode portion 1120 is located below to heat water, a detergent, or a wash liquid and then the drum 130 rotates for a washing operation, power efficiency of the washing machine 3 may be increased.

Also, in the case of the washing machine 4 of FIGS. 4A and 4B, the first electrode portion 1110 and the second electrode portion 1120 in a planar shape may be disposed in parallel.

Referring to FIG. 4B, a washing space may be formed in the cabinet 210 of the washing machine 4 and the second electrode portion 1120 in the planar shape may be disposed in a center thereof. Also, the first electrode portion 1110 in the planar shape may be disposed on both sides of the second electrode portion 1120 in parallel. As a result thereof, two heating spaces W may be formed in the washing machine 4.

Also, as shown in FIG. 4C, the jet side 234*a* of the jet portion 234 of the washing machine 4 may be embodied as the first electrode portion 1110 or the second electrode portion 1120 capable of forming an electric field. As a result thereof, an electric field may be formed between the jet side 234*a* embodied as the first electrode portion 1110 or the second electrode portion 1120 and the first electrode portion 1110 or the second electrode portion 1120 in the cabinet 210.

Also, the washing machine 5 of FIG. 5 may include the first electrode portion 1110 and the second electrode portion 1120 spaced apart and facing each other to form a path for conveying laundry.

Referring to FIG. 5, the first electrode portion 1110 may be provided above the path for conveying the laundry and the second electrode portion 1120 may be provided below the path for conveying the laundry. In detail, in a section B between the first section A and the second section C, the first electrode portion 1110 may be provided above and the second electrode portion 1120 may be provided below. As a result thereof, the laundry which receives a wash liquid in the first section A may be exposed to an electric field formed by the electric field forming portion 1100 before entering the second section C. The wash liquid included in the laundry may be heated by the electric field, and thereby contaminants may be vigorously separated from the laundry.

Also, in a section D between the second section C and the third section E, the first electrode portion 1110 may be provided above and the second electrode portion 1120 may be provided below. As a result thereof, the washing water which receives water in the second section C may be exposed again to an electric field formed by the electric field forming portion 1100 before entering the third section E. Also, in this case, the water included in the laundry may be heated by the electric field, thereby increasing efficiency in a rinsing operation.

Particularly, when laundry is exposed to an electric field and simultaneously a mechanical force is applied to the laundry, contaminants may be more easily separated from the laundry.

The electric field forming portion 1100 capable of being variously installed in washing machines as described above may further include an insulating portion which prevents the first electrode portion 1110 and the second electrode portion 1120 from coming in contact with water, a detergent, or a wash liquid. Since the contact between the first electrode portion 1110 and the second electrode portion 1120 and the water, the detergent, or the wash liquid becomes an obstacle in performing dielectric heating, the insulating portion may physically cut off the first electrode portion 1110 and the second electrode portion 1120 from the water, the detergent, or the wash liquid.

The first electrode portion 1110 may be provided to be grounded and to have a grounded potential, and the second electrode portion 1120 may be connected to the power supply portion 500.

The power supply portion 500 may supply AC power to the second electrode portion 1120. When the power supply portion 500 supplies the power to the second electrode portion 1120, an electric field may be formed between the second electrode portion 1120 and the first electrode portion 1110, Here, since the power supplied by the power supply portion 500 is AC power, the electric fields formed between the second electrode portion 1120 and the first electrode portion 1110 may be alternately formed. As a result thereof, water, a detergent, or a wash liquid vibrates due to the alternating electric fields, and thereby the water, the detergent, or the wash liquid is heated.

The power supply portion 500 may generally supply a high frequency AC power from 30 kHz to 300 MHz to the first electrode portion 1110 and may provide a radio frequency (RF) signal. Since the alternation of the formed electric fields corresponds to a frequency of the supplied AC power, the power supply portion 500 may induce ions of the water, the detergent, or the wash liquid to vibrate more vigorously by supplying AC power with high frequency.

A sensor portion 300 may sense states of the water, the detergent, or the wash liquid supplied to the heating space W and the laundry accommodated in the heating space W. Here, the state of the water, the detergent, or the wash liquid may refer to physical quantities such as a weight, a temperature, and a volume of the water, the detergent, or the wash liquid and an electric signal transferred to an electrode and the state of the laundry may refer to physical quantities such as a weight, a temperature, and a volume of the laundry and an electric signal transferred to an electrode.

For this, the sensor portion 300 may include a weight sensor which senses weights of the water, the detergent, or the wash liquid and the laundry including the same, a temperature sensor which senses temperatures of the water, the detergent, or the wash liquid and the laundry including the same, a volume sensor which senses volumes of the water, the detergent, or the wash liquid and the laundry including the same, and a signal sensor which senses a change in the electric signal transferred to the electrode.

The controller 400 may determine a level of the supplied AC power based on the states of the water, the detergent, or the wash liquid and the laundry including the same, sensed by the sensor portion 300, In detail, the controller 400 may determine the level of the AC power satisfying maximum power supply conditions based on the sensed states of the water, the detergent, or the wash liquid and the laundry including the same and a distance between the electrodes. The controller 400 may control the power supply portion 500 according to the level of the AC power determined as described above.

The controller 400 may be embodied as hardware such as a micro processor or software operated by hardware.

The impedance matching portion 1000 may measure load impedance of laundry and perform impedance matching based thereon to transmit maximum power to a load. Since power of a receiving end may vary with the load impedance of the laundry, the impedance matching portion 1000 may transmit the maximum power to the receiving end by matching a difference between the load impedance of the laundry and impedance of a sending end. As a result thereof, the washing machine may increase the efficiency of heating the laundry.

The impedance matching portion 1000 may perform a predetermined operation to determine the difference between the load impedance of the laundry and the impedance of the sending end. Also, the impedance matching portion 1000 may check load impedance corresponding to the impedance of the sending end in a predetermined parameter table.

The impedance matching portion 1000 may be provided as an additional component in the washing machine or may be provided as one component of the controller 400.

So far, the washing machine which heats water, a detergent, or a wash liquid using the dielectric heating method has been described. Hereinafter, several embodiments in which the electric field forming portion is installed in the washing machine which employs the dielectric heating method will be described.

FIGS. 9A to 9F are views illustrating several embodiments in which the electric field forming portion is installed in the washing machine of FIGS. 4A and 4B.

Figure 9A:
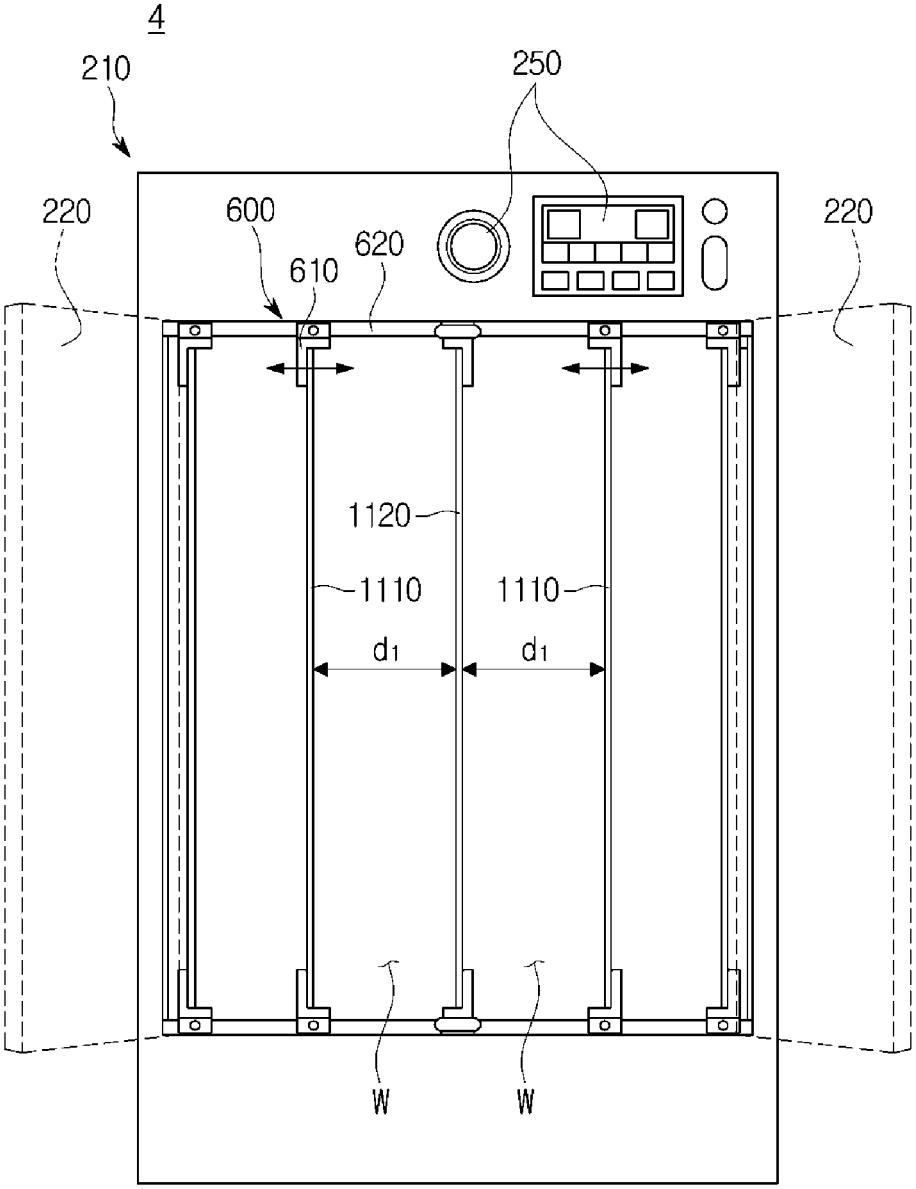
FIGS. 9A to 9F are views illustrating several embodiments in which an electric field forming portion is installed in the washing machine of FIGS. 4A to 4C.
Figure 9B:
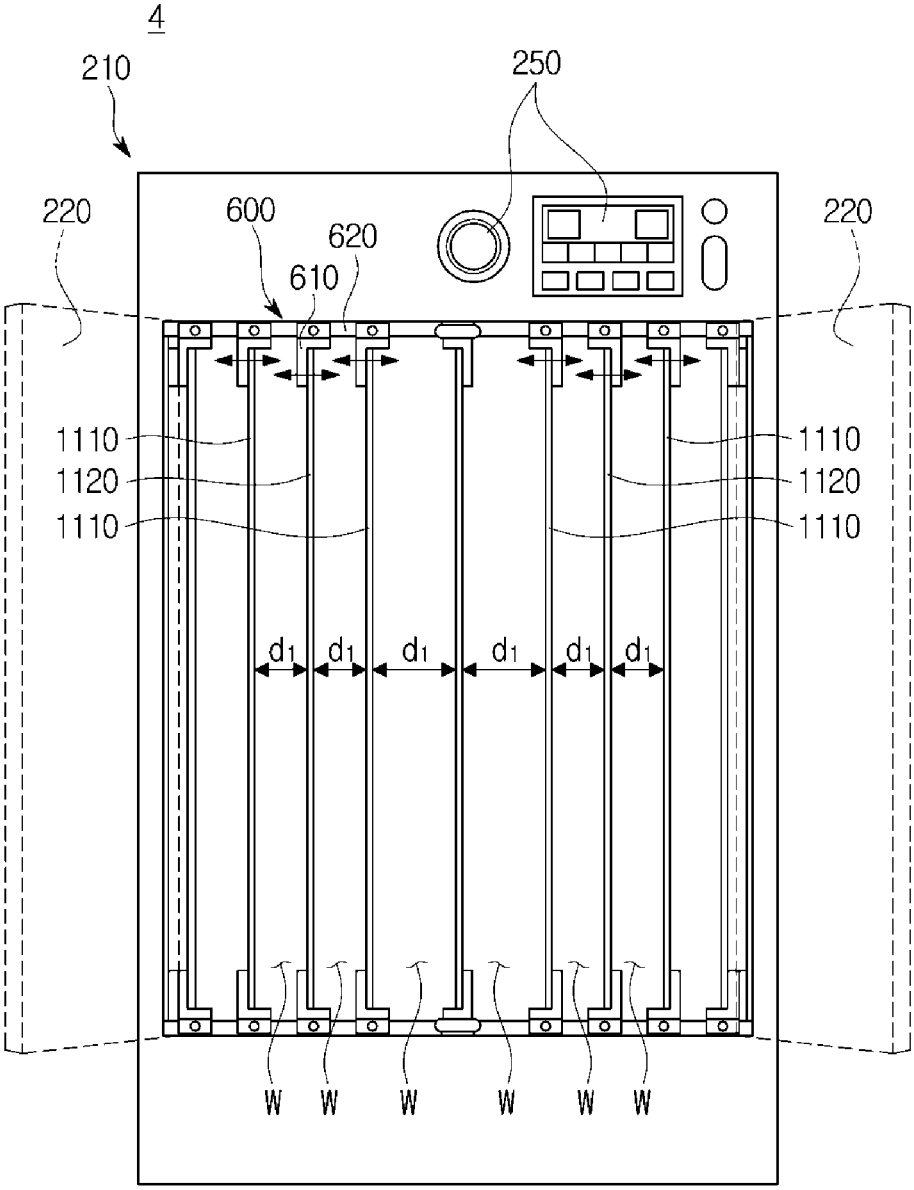
Figure 9C:
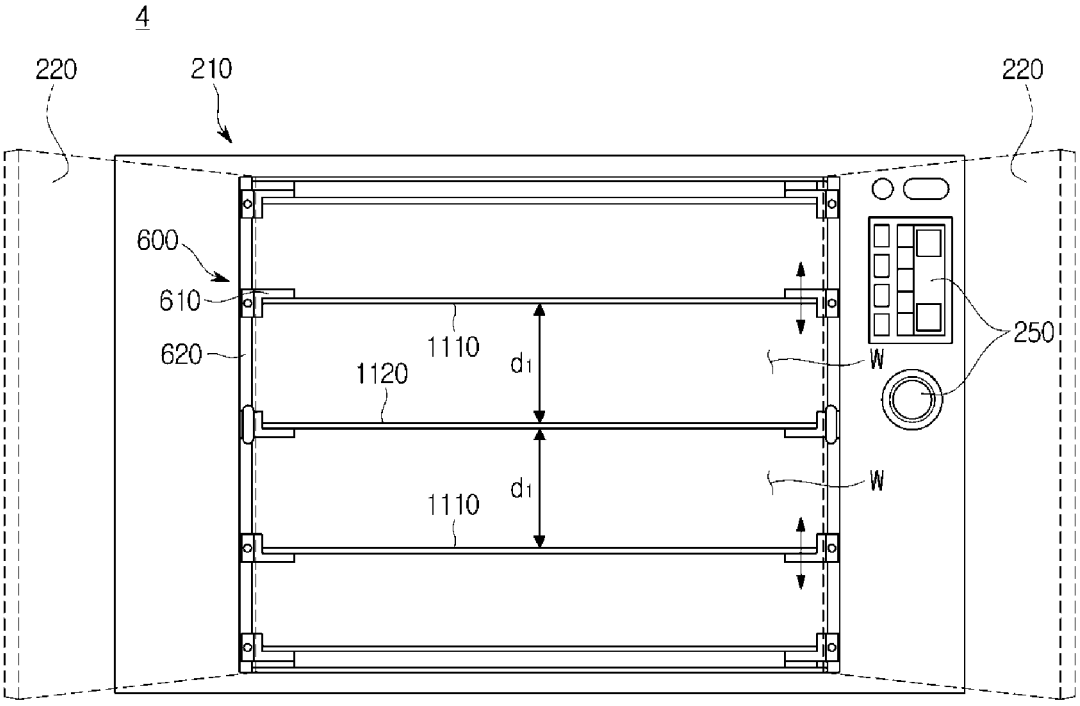

FIGS. 9A to 9C are front views of the washing machine 4 of FIGS. 4A and 4B which includes the electric field forming portion 1100 in accordance with several embodiments and more particularly illustrate a case in which the first electrode portion 1110 and the second electrode portion 1120 are provided in planar shapes.

Referring to FIG. 9A, the cabinet 210 of the washing machine 4 may form a washing space therein and the second electrode portion 1120 in the planar shape may be disposed in a center thereof. Also, the first electrode portion 1110 in the planar shape may be disposed on both sides of the second electrode portion 1120 in parallel. As a result thereof, two heating spaces W may be formed in the washing machine 4.

Unlike FIG. 9A, the electric field forming portion 1100 may include a plurality of first electrode portions 1110 and a plurality of second electrode portions 1120. In detail, the first electrode portions 1110 and the second electrode portions 1120 may be alternately disposed in parallel in the washing space in the cabinet 210 of the washing machine 4. In FIG. 9B, three second electrode portions 1120 and four first electrode portions 1110 may be alternately arranged, thereby forming six heating spaces W.

FIGS. 9A and 9B illustrate a case in which the first electrode portions 1110 and the second electrode portions 1120 are vertically disposed. Unlike this, the first electrode portions 1110 and the second electrode portions 1120 may be horizontally disposed to horizontally divide the washing space in the cabinet 210 to form the heating spaces W.

Referring to FIG. 9C, it may be known that the first electrode portions 1110 and the second electrode portions 1120 are disposed in a direction perpendicular to a direction in which the first electrode portions 1110 and the second electrode portions 1120 of FIGS. 9A and 9B are disposed. As a result thereof, the heating spaces W may be formed in the cabinet 210 in a direction parallel to the direction in which the first electrode portions 1110 and the second electrode portions 1120 are disposed.

The washing machine 4 which includes the electric field forming portion 1100 provided as shown in FIGS. 9A to 9C may further include the electrode movement portion 600 which adjusts a distance between the first electrode portion 1110 and the second electrode portion 1120 of the electric field forming portion 1100. The electrode movement portion 600 may adjust the distance between the first electrode portion 1110 and the second electrode portion 1120. For this, the electrode movement portion 600 may include a rail 620 which extends in the direction in which the first electrode portions 1110 and the second electrode portions 1120 are arranged and a conveying portion 610 movably coupled with the rail 620.

Referring to FIGS. 9A and 9B, the rail 620 may be installed on an upper side and a lower side of the cabinet 210 and the conveying portion 610 may be coupled with the rail 620 and movable along the rail 620. Also, since the conveying portion 610 is fixed to the first electrode portion 1110 or the second electrode portion 1120, the first electrode portion 1110 and the second electrode portion 1120 are also movable along the rail 620.

In the case of the washing machine 4 of FIG. 9C, the rail 620 may be installed at left and right sides of the cabinet 210 and the conveying portion 610 may move the first electrode portions 1110 and the second electrode portions 1120 along the rail 620 installed on the sides.

The controller 400 may determine a distance between electrodes based on the states of water, the detergent, or the wash liquid and the laundry including the same, sensed by the sensor portion 300. In detail, the controller 400 may determine the distance between the electrodes satisfying maximum power supply conditions based on the sensed states of the water, the detergent, or the wash liquid and the laundry including the same and a level of AC power corresponding to the determined distance between the electrodes.

Accordingly, the controller 400 may control the electrode movement portion 600 to space the first electrode portion 1110 and the second electrode portion 1120 apart at the determined distance between the electrodes and may control the power supply portion 500 to supply the AC power at the determined level.

Figure 9D:
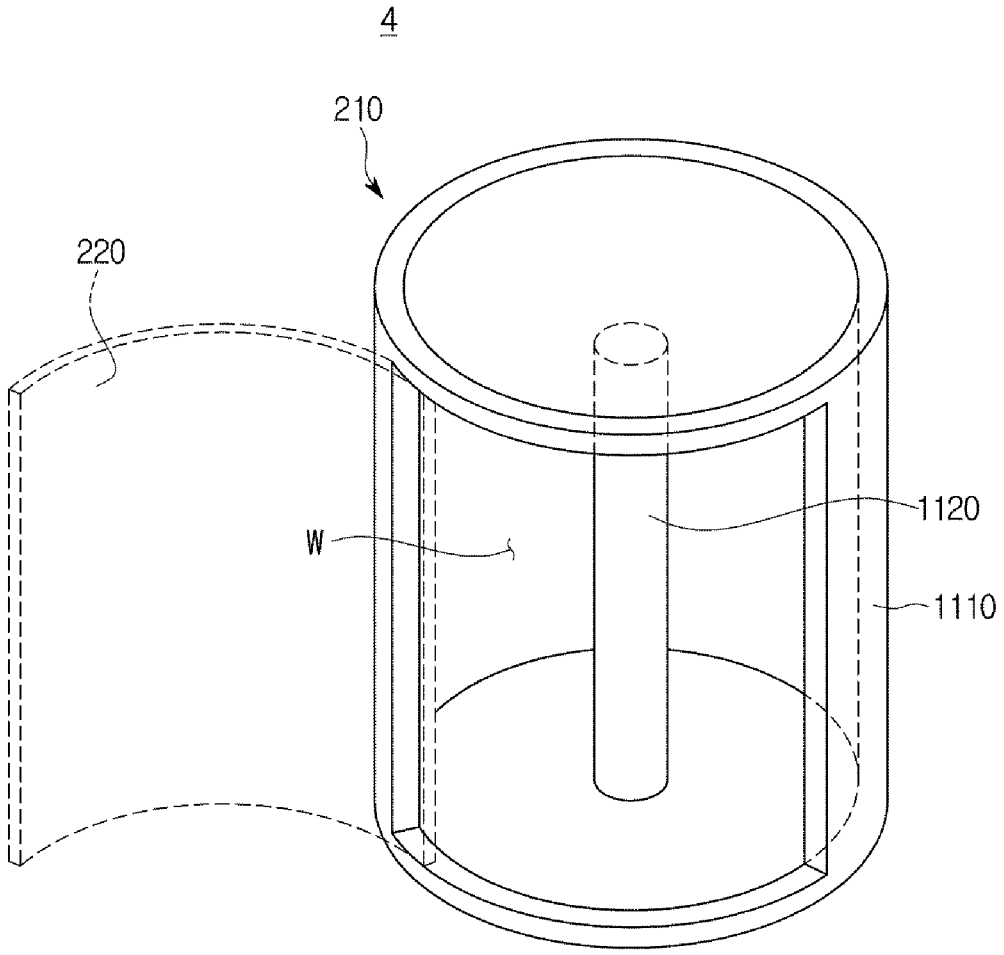

Unlike FIGS. 9A to 9C, the washing machine 4 may have a cylindrical shape. Referring to FIG. 9D, the cabinet 210 of the washing machine 4 is provided in a cylindrical shape and a washing space may be formed therein. Here, the second electrode portion 1120 may be disposed in a cylindrical shape in a center of the washing space and an inner side of the cabinet 210 may be totally formed as the first electrode portion 1110. As a result thereof, the entire washing space which surrounds the second electrode portion 1120 may be the heating space W.

So far, a case in which each of the first electrode portion 1110 and the second electrode portion 1120 is provided in a single electrode shape has been described. However, the first electrode portion 1110 and the second electrode portion 1120 may be embodied as a plurality of first electrodes 1111 and a plurality of second electrodes 1121, respectively.

Figure 9E:
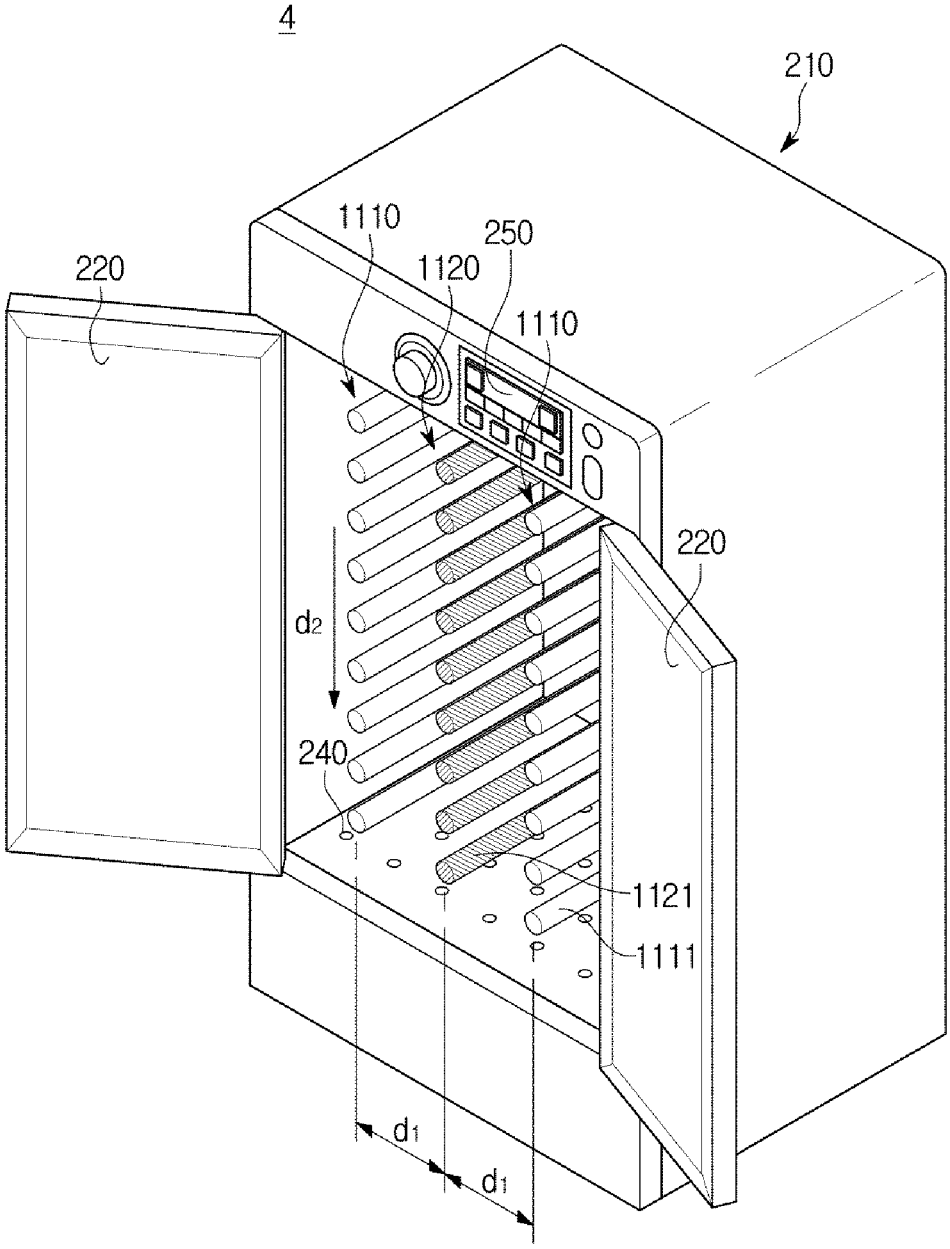
Figure 9F:
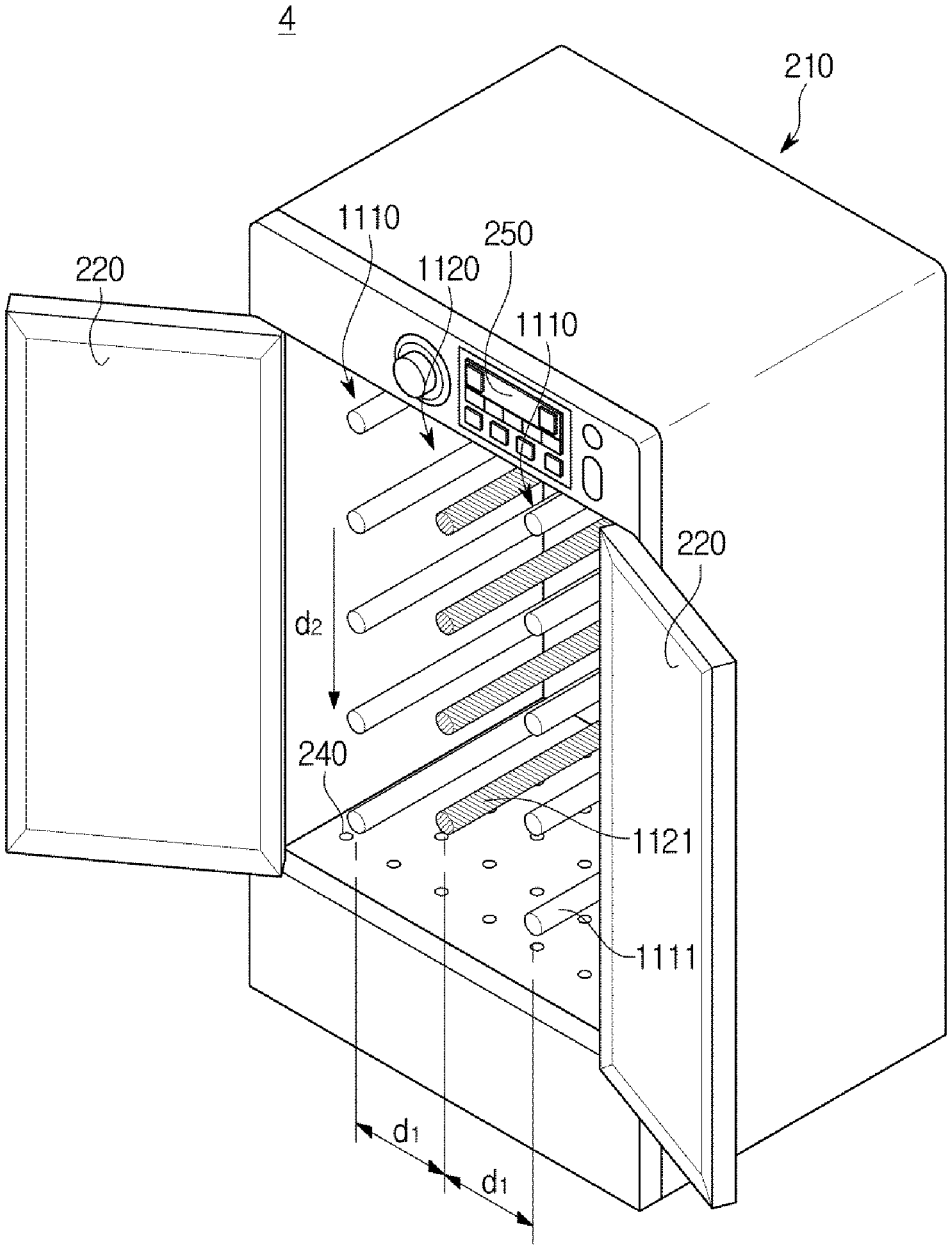

FIGS. 9E and 9F are perspective views of the washing machine 4 of FIGS. 4A and 4B including the electric field forming portion 1100 in accordance with several embodiments and more particularly illustrate that the first electrode portion 1110 and the second electrode portion 1120 include the plurality of first electrodes 1111 and the plurality of second electrodes 1121, respectively.

Referring to FIGS. 9E and 9F, the first electrode portion 1110 including the plurality of first electrodes 1111 and the second electrode portion 1120 including the plurality of second electrodes 1121 may be disposed in parallel in the washing space. That is, the plurality of first electrodes 1111 and the plurality of second electrodes 1121 may be arranged in parallel in a second direction d2.

FIG. 9E illustrates a case in which the plurality of first electrodes 1111 and the plurality of second electrodes 1121 are positioned at the same heights in the washing machine 4. On the other hand, in the washing machine 4 shown in FIG. 9F, the plurality of second electrodes 1121 are not positioned at the same height as the plurality of first electrodes 1111. That is, the plurality of second electrodes 1121 may be arranged alternately with the plurality of first electrodes 1111 based on the heights thereof.

Referring to FIGS. 9A to 9C, when the first electrode portion 1110 and the second electrode portion 1120 in the planar shapes are disposed in parallel, the electric field may be formed in the heating space W in a first direction d1 perpendicular to the first electrode portion 1110 and the second electrode portion 1120.

On the other hand, in FIG. 9D, since the first electrode portion 1110 is disposed to be in a shape that surrounds the second electrode portion 1120 in a cylindrical shape, the electric field may be formed radially.

Unlike this, in the washing machine 4 shown in FIGS. 9E and 9F, since the first electrode portion 1110 and the second electrode portion 1120 are disposed in parallel, the electric field may be formed in the first direction d1 as shown in FIGS. 9A to 9C. Here, the first direction d1 may be perpendicular to the second direction d2 in which the plurality of first electrodes 1111 and the plurality of second electrodes 1121 are arranged.

So far, a case in which the washing machine 4 of FIGS. 4A and 4B includes the electric field forming portion 1100 has been described. Unlike this, the electric field forming portion 1100 may be provided in washing machines in shapes different from the embodiment shown in FIGS. 4A and 4B, which will be described below.

Figure 10A:
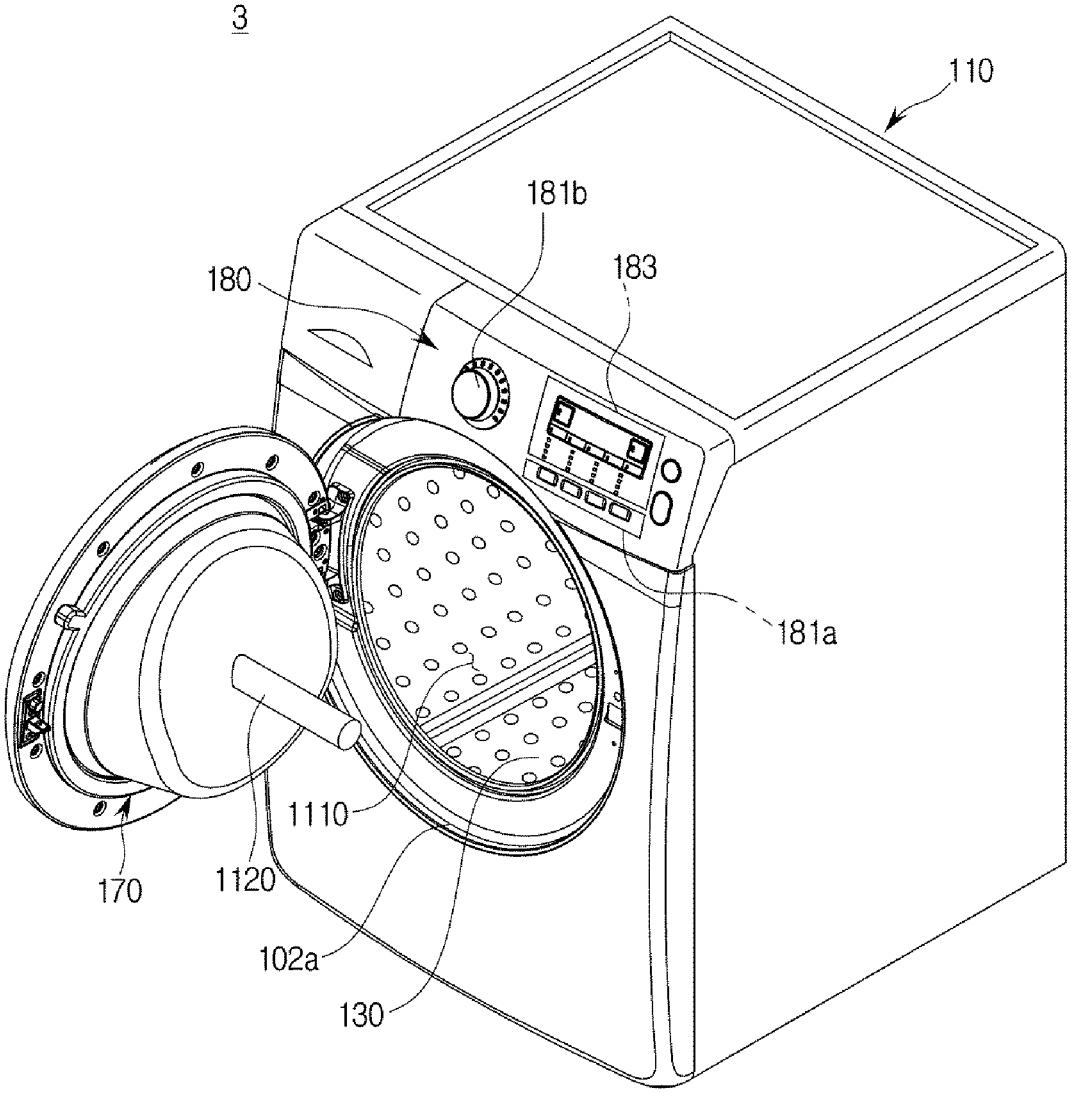
FIGS. 10A to 10C are views illustrating several embodiments in which an electric field forming portion is installed in the washing machine of FIGS. 3A and 3B.
Figure 10B:
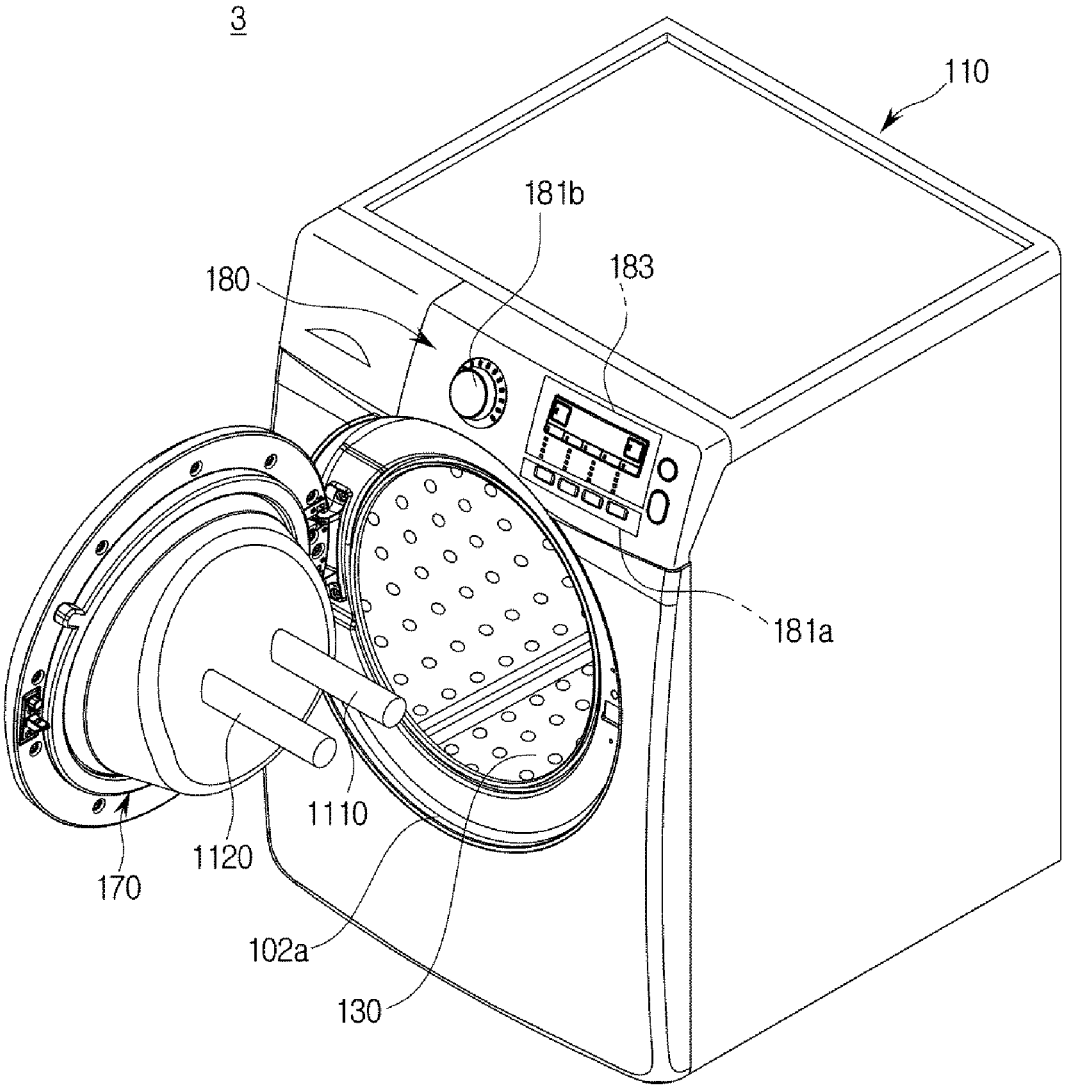
Figure 10C:
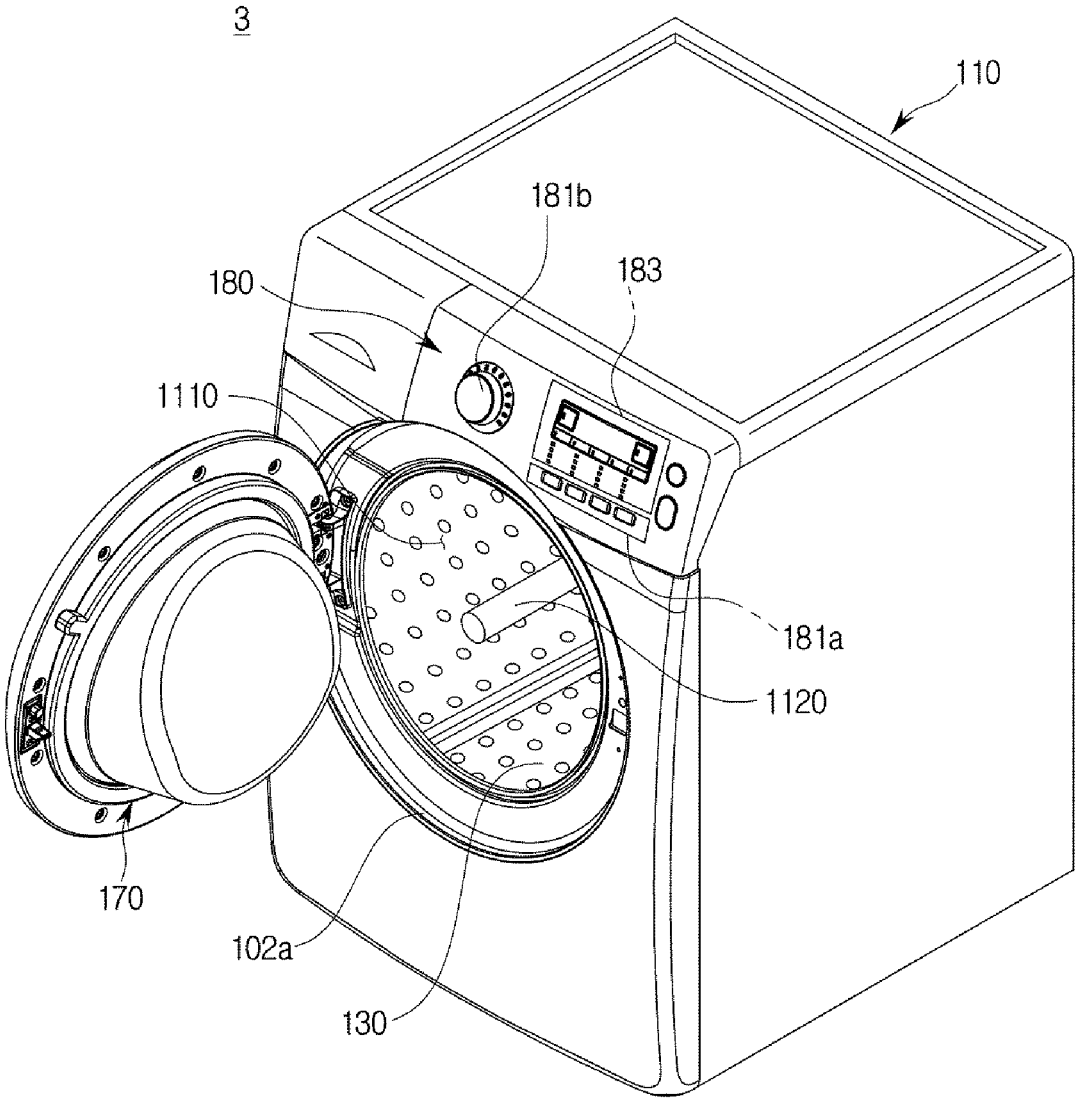

FIGS. 10A to 10C are views illustrating several embodiments in which the electric field forming portion is installed in the washing machine of FIGS. 3A and 3B. As described with reference to FIGS. 3A and 3B, the washing machine 3 of FIGS. 3A and 3B may be formed to allow all or some of the plurality of lifters 126 to include the first electrode portion 1110 or the second electrode portion 1120. Also, other electrode portions may be formed throughout or at a part of an area of the inner side of the drum 130 except a part where the lifters 126 are formed. As a result thereof, the heating space W where an electric field is formed may be formed between the lifter 126 including the second electrode portion 1120 and the inner side of the drum 130 in the washing space in the drum 130.

Unlike this, the washing machine 3 of FIGS. 3A and 3B may include the electric field forming portion 1100 installed using various methods.

FIG. 10A illustrates a case in which the second electrode portion 1120 in a cylindrical shape is provided on an inner side of the door 170 and the entire inside of the drum 130 is formed as the first electrode portion 1110. When the door 170 pivots and closes an opened portion of the drum 130, the second electrode portion 1120 provided on the inner side of the door 170 may be inserted into a washing space in the drum 130. When power is supplied to the second electrode portion 1120 inserted into the washing space, an electric field may be formed due to a relationship between the second electrode portion 1120 in the center of the washing space and the first electrode portion 1110 of the inner side of the drum 130. Accordingly, the washing space in the drum 130 may be the heating space W where the electric field is formed.

Also, FIG. 10B illustrates a case in which the first electrode portion 1110 and the second electrode portion 1120 in cylindrical shapes are provided together on the inner side of the door 170. When the door 170 pivots and closes the opened portion of the drum 130, the first electrode portion 1110 and the second electrode portion 1120 provided on the inner side of the door 170 may be inserted into the washing space in the drum 130. When power is supplied to the second electrode portion 1120 inserted into the washing space, an electric field may be formed between the first electrode portion 1110 and the second electrode portion 1120 positioned in the washing space. Accordingly, the heating space W may be formed between the first electrode portion 1110 and the second electrode portion 1120 in the washing space in the drum 130.

Additionally, as shown in FIG. 10C, the second electrode portion 1120 in a cylindrical shape may be provided in the washing space in the drum 130 and the first electrode portion 1110 may be formed on the inner side of the drum 130. As a result thereof, the heating space W may be formed between the first electrode portion 1110 and the second electrode portion 1120 in the washing space in the drum 130.

Also, the electric field forming portion 1100 may be provided in the washing machine 1 of FIG. 2A. Hereinafter, several embodiments in which the electric field forming portion 1100 is provided in the washing machine 1 of FIG. 2A will be described.

Figure 11A:
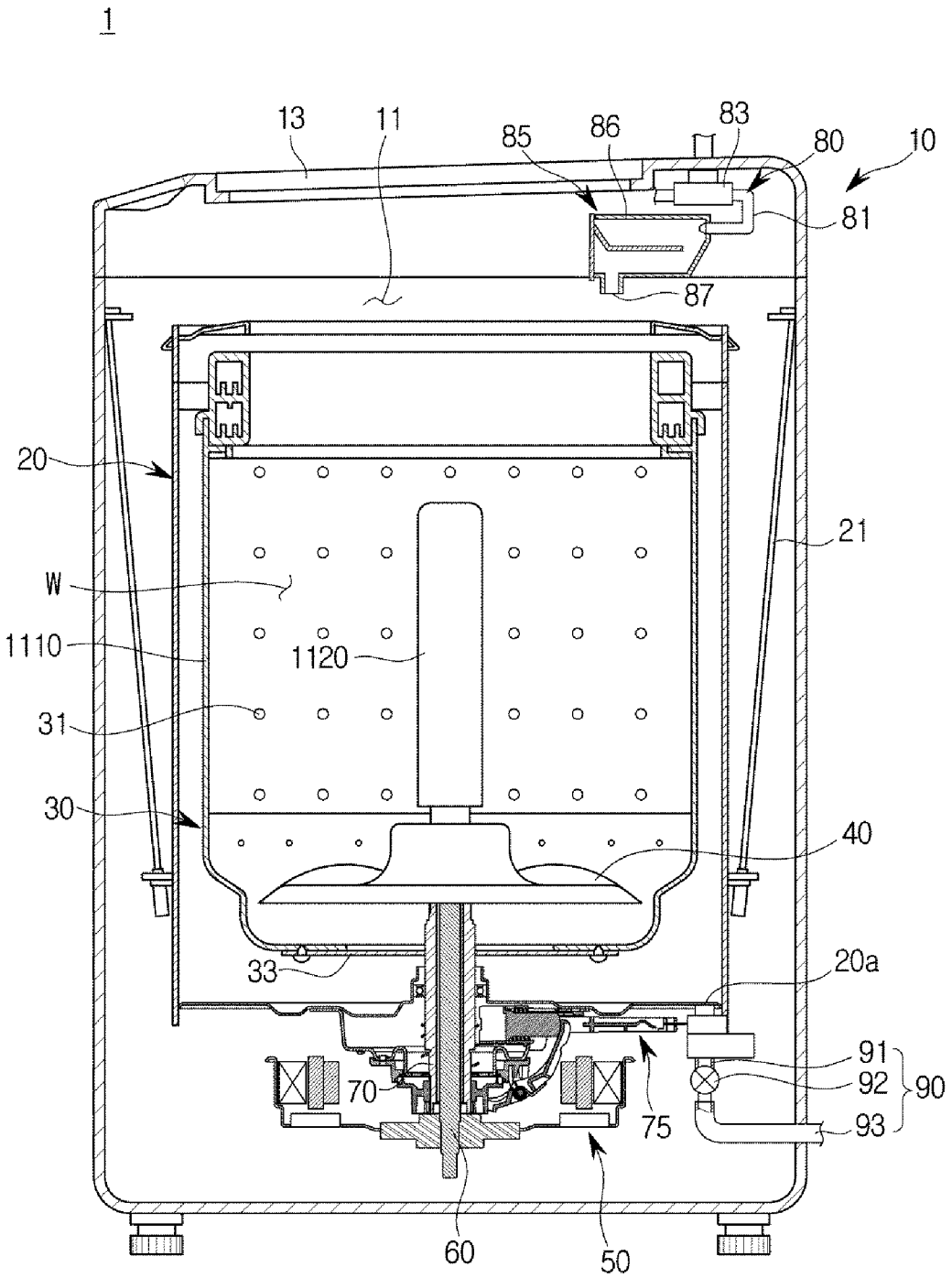
FIGS. 11A and 11B are views illustrating several embodiments in which an electric field forming portion is installed in the washing machine of FIG. 2A.
Figure 11B:
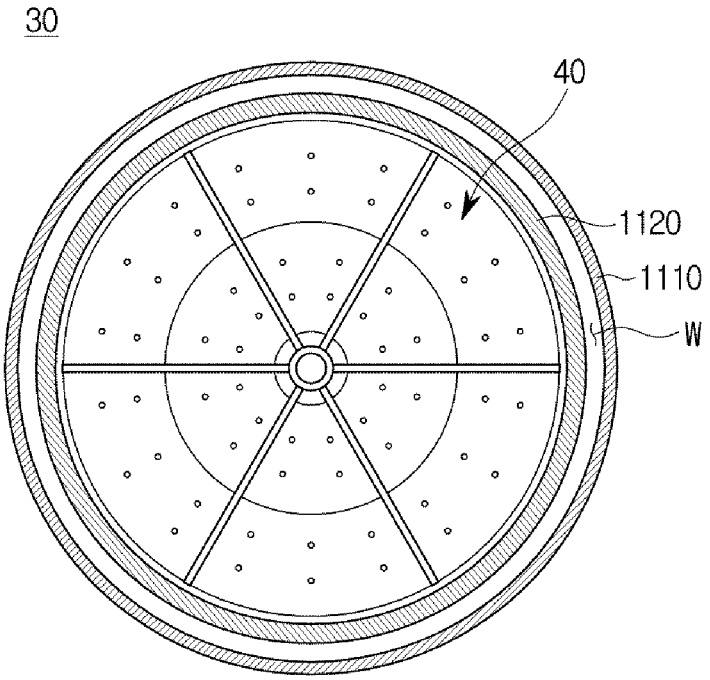

FIGS. 11A and 11B are views illustrating several embodiments in which the electric field forming portion is installed in the washing machine of FIG. 2A.

FIG. 2A illustrates a case in which the pulsator 40 includes the first electrode portion and the second electrode portion.

Unlike this, FIG. 11A illustrates a case in which the second electrode portion 1120 in a cylindrical shape is provided in a center of the rotating tub 30 and an inner side of the rotating tub 30 is formed as the first electrode portion 1110. In detail, the second electrode portion 1120 in the cylindrical shape extending from a rotation center of the pulsator 40 in a direction in which the rotating tub 30 is opened may be provided in the center of the rotating tub 30 and the entire inside of the rotating tub 30 which surrounds the same may be provided as the first electrode portion 1110. As a result thereof, a washing space of the rotating tub 30 may be the heating space W where an electric field is formed by the first electrode portion 1110 and the second electrode portion 1120.

Also, the first electrode portion 1110 and the second electrode portion 1120 may be provided at a bottom surface of the rotating tub 30. FIG. 11B is a plane view illustrating a bottom of the rotating tub 30 in accordance with one embodiment of the present disclosure and illustrates that the pulsator 40 rotatably installed at the bottom of the rotating tub 30 is provided. Here, the second electrode portion 1120 may be provided to surround an outer perimeter of the pulsator 40 and the first electrode portion 1110 may be provided to surround an outer perimeter of the second electrode portion 1120. As a result thereof, the heating space W where an electric field is formed may be formed between the first electrode portion 1110 and the second electrode portion 1120, and water, a detergent, or a wash liquid present in the heating space W may be heated.

So far, a case in which the first electrode portion 1110 and the second electrode portion 1120 are provided in particular shapes has been described. Unlike this, the first electrode portion 1110 and the second electrode portion 1120 may be formed as patterns on a surface of one component of a washing machine. Hereinafter, several embodiments of the electric field forming portion 1100 in a pattern shape will be described.

Figure 12:
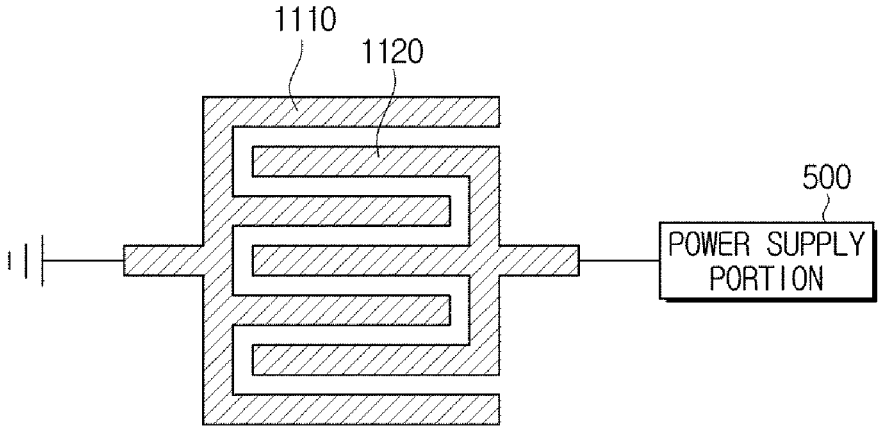
FIG. 12 is a view of a pattern-shaped electric field forming portion in accordance with one embodiment of the present disclosure.

FIG. 12 is a view of a pattern-shaped electric field forming portion in accordance with one embodiment of the present disclosure. FIGS. 13A to 13D are views illustrating several embodiments in which the electric field forming portion is installed in each of washing machines in accordance with several embodiments of the present disclosure.

The electric field forming portion 1100 may include the first electrode portion 1110 and the second electrode portion 1120 which form predetermined patterns. Referring to FIG. 12, the first electrode portion 1110 which is grounded and the second electrode portion 1120 which receives AC power from the power supply portion 500 may form a pattern and be spaced apart. An electric field may be formed in a space in which the first electrode portion 1110 and the second electrode portion 1120 are formed to be spaced apart and may heat water, a detergent, or a wash liquid.

The washing machine may include one pattern-shaped electric field forming portion 1100 and may include a plurality of such electric field forming portions 1100 as necessary.

Figure 13A:
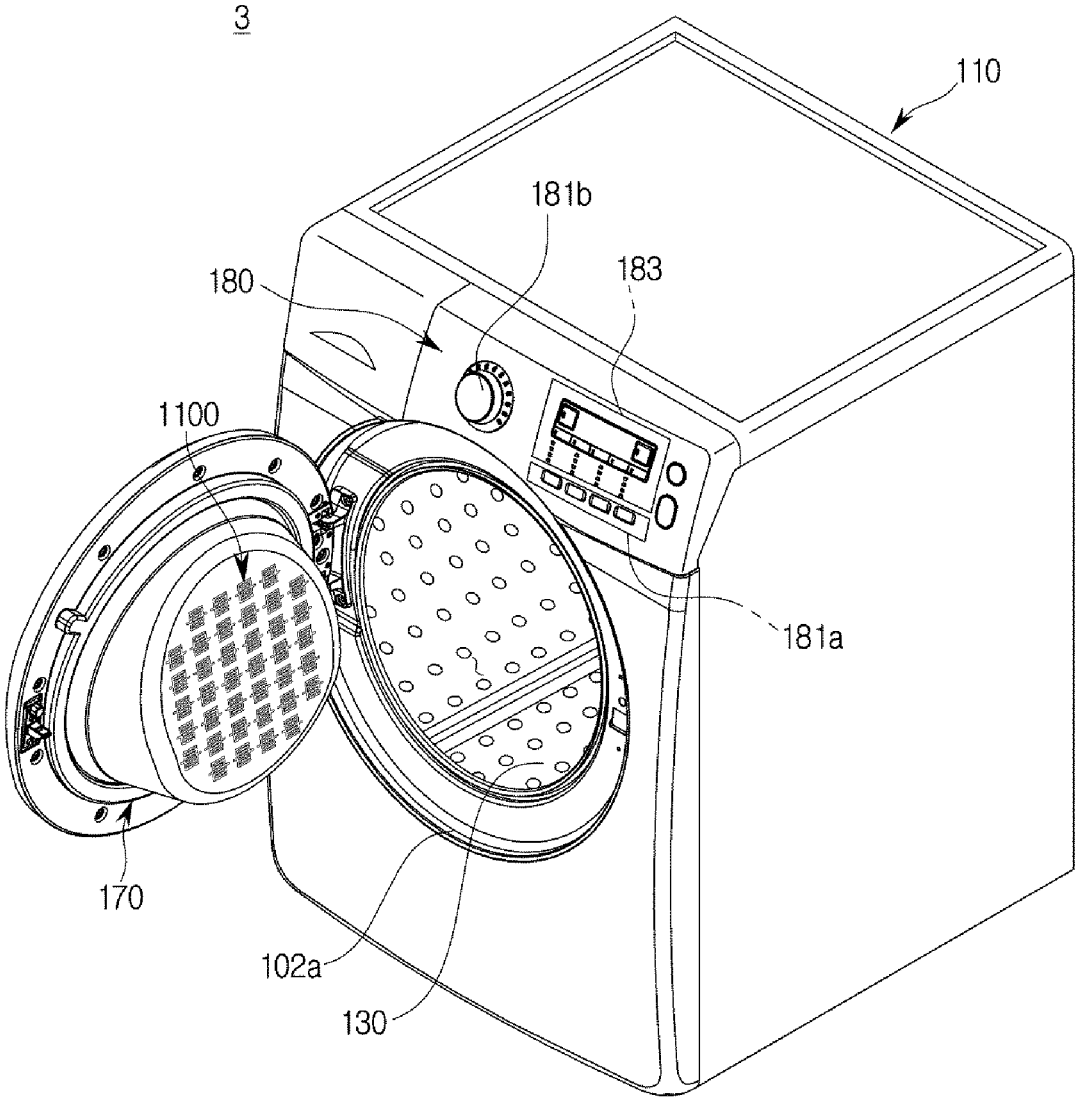
FIGS. 13A to 13D are views illustrating several embodiments in which the electric field forming portion of FIG. 12 is installed in each of washing machines in accordance with several embodiments of the present disclosure.
Figure 13B:
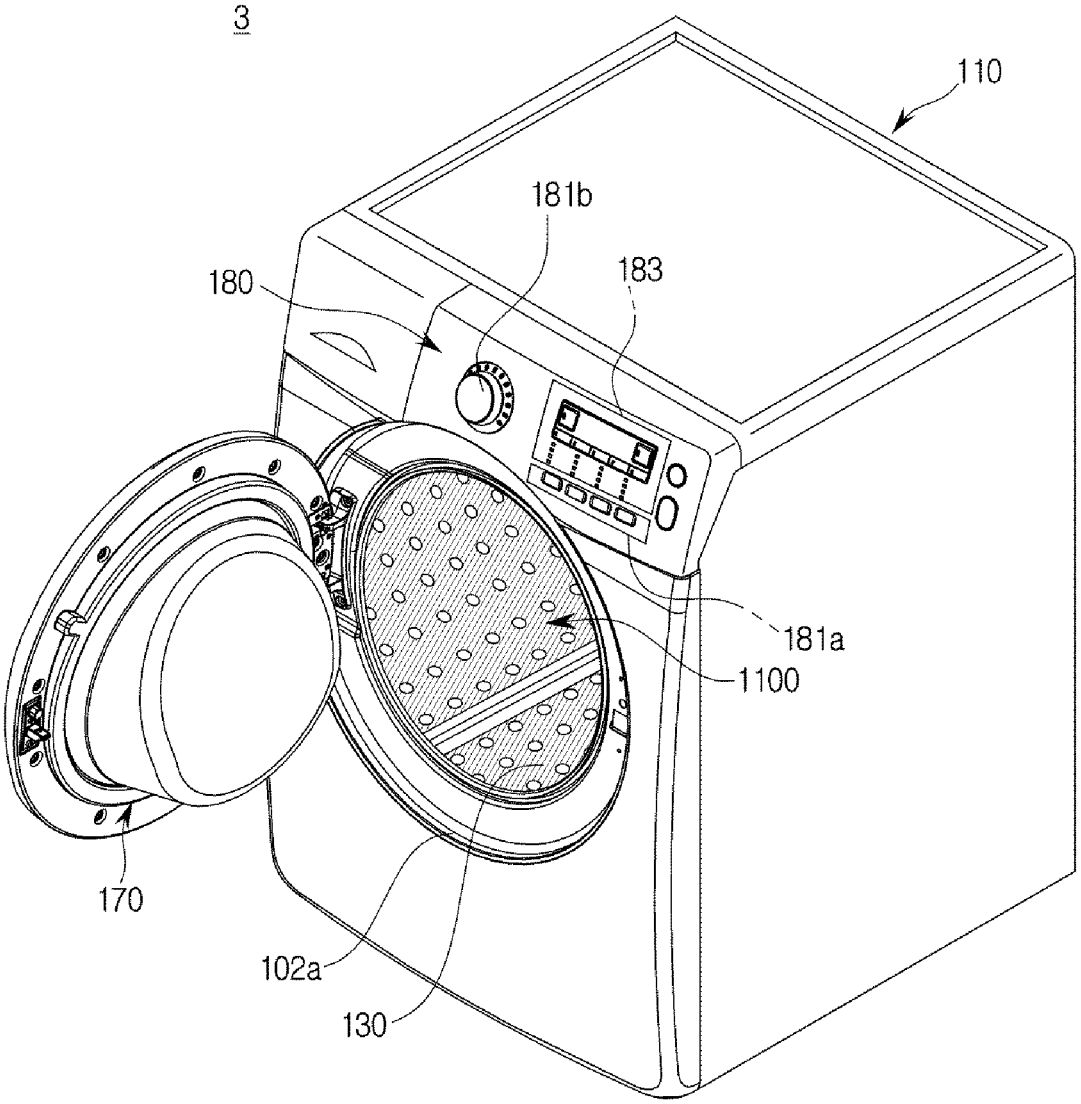

The pattern-shaped electric field forming portion 1100 shown in FIG. 12 may be applied to washing machines in accordance with various embodiments. Referring to FIGS. 13A and 13B, the pattern-shaped electric field forming portion 1100 of FIG. 12 may be applied to the washing machine 3 of FIGS. 3A and 3B.

As shown in FIG. 13A, the electric field forming portion 1100 in the pattern shape may be provided on the inner side of the door 170. As a result thereof, when the door 170 pivots and closes the opened portion of the drum 130, the pattern-shaped electric field forming portion 1100 may heat water, a detergent, or a wash liquid and laundry including the same positioned in an area of an inside of the drum 130, in which an electric field is formed.

Unlike this, the pattern-shaped electric field forming portion 1100 may be provided on the inner side of the drum 130. Referring to FIG. 13B, the electric field forming portion 1100 which forms the pattern shown in FIG. 12 using the first electrode portion 1110 and the second electrode portion 1120 may be provided on the inner side of the door 170, In FIG. 13B, a slashed area may refer to the pattern-shaped electric field forming portion 1100.

Figure 13C:
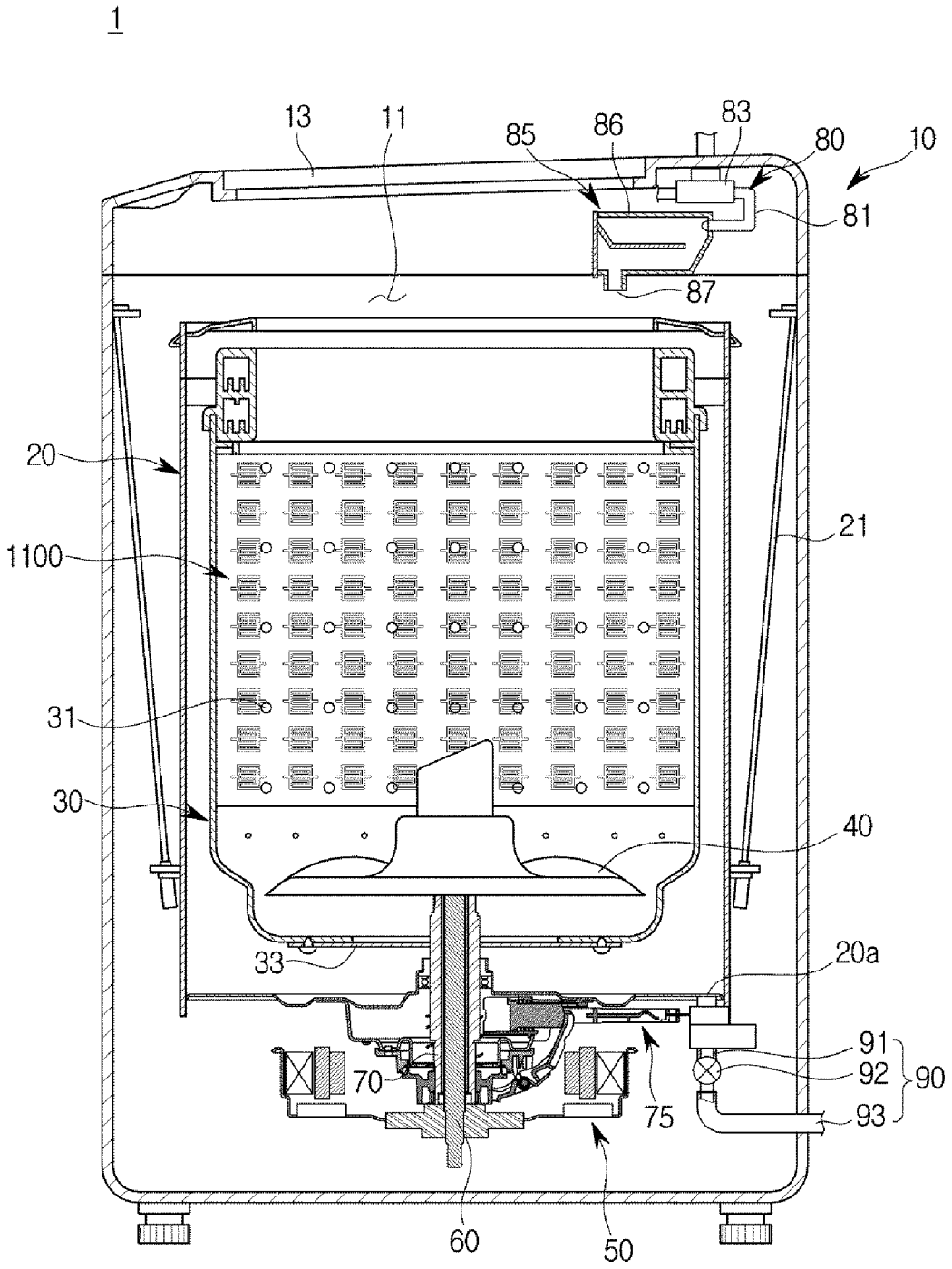

Also, the washing machine 1 of FIG. 2A may include the pattern-shaped electric field forming portion 1100. Referring to FIG. 13C, the pattern-shaped electric field forming portion 1100 may be provided on the inner side of the rotating tub 30. As a result thereof, water, a detergent, or a wash liquid and laundry including the same positioned in an area where the pattern-shaped electric field forming portion 1100 forms an electric field may be heated.

Figure 13D:
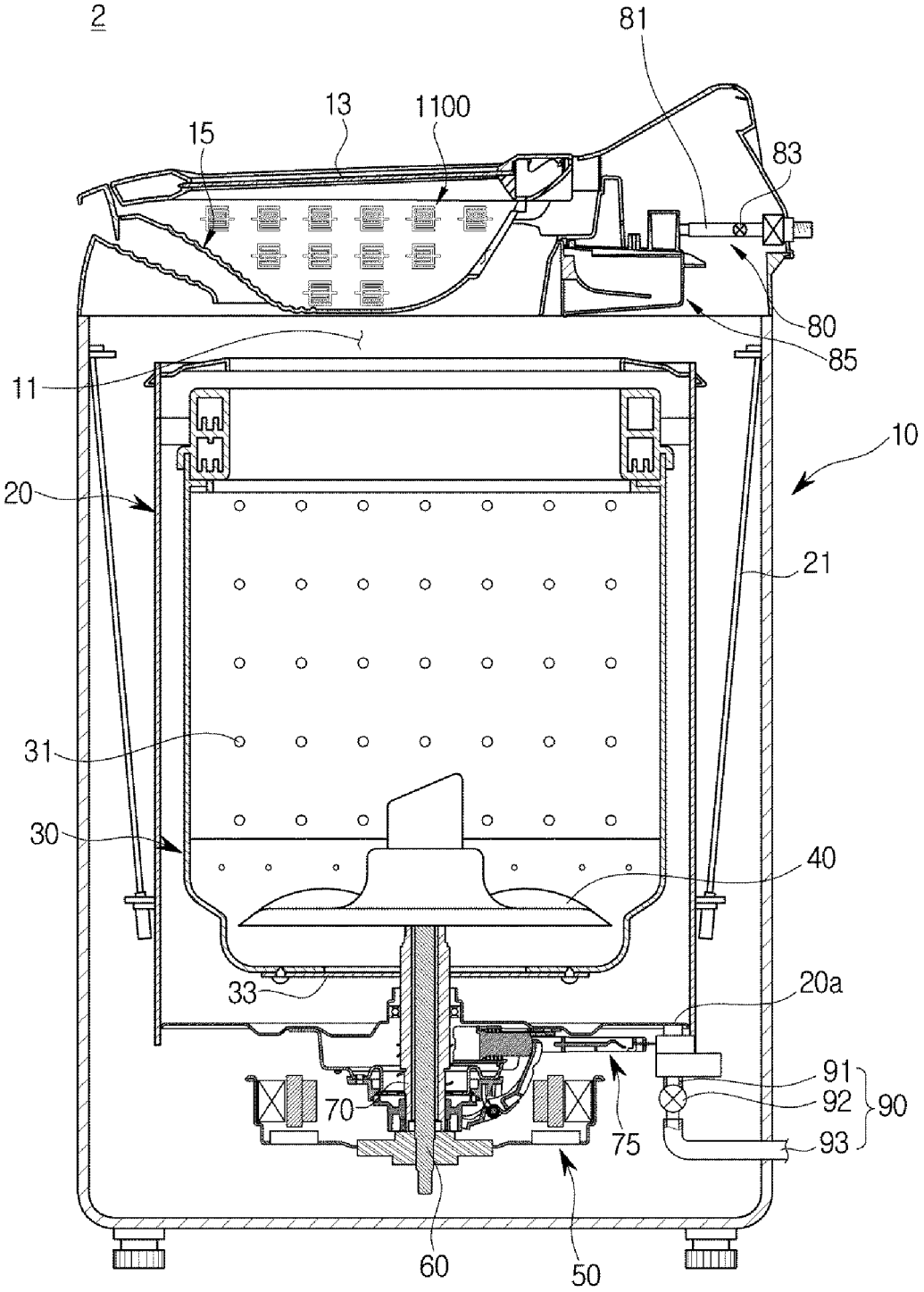

Also, the washing machine 2 of FIG. 2B including the auxiliary washing unit 15 may include the pattern-shaped electric field forming portion 1100. The washing machine 2 of FIG. 2B may also include the pattern-shaped electric field forming portion 1100 provided at the rotating tub 30 as shown in FIG. 13C and additionally include the pattern-shaped electric field forming portion 1100 provided on an inner side of the auxiliary washing unit 15. Referring to FIG. 13D, water, a detergent, or a wash liquid supplied to the auxiliary washing unit 15 and laundry including the same may be heated by the pattern-shaped electric field forming portion 1100 formed on the inner side of the auxiliary washing unit 15.

In addition to the pattern shapes described above, the electric field forming portion 1100 may be embodied in various pattern shapes.

Figure 14:
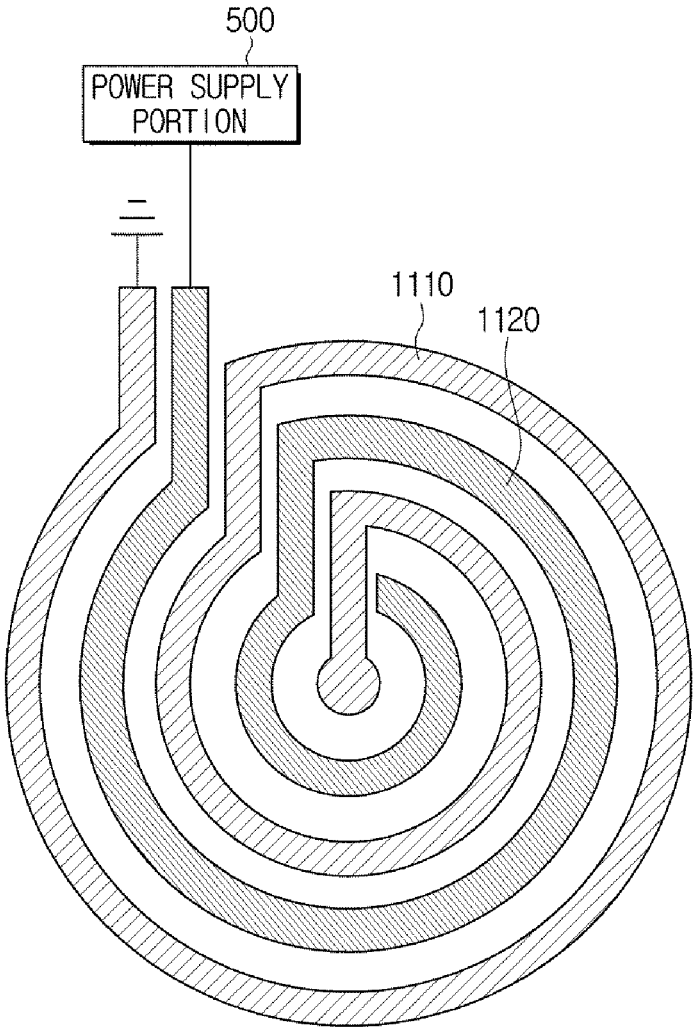
FIG. 14 is a view of a pattern-shaped electric field forming portion in accordance with another embodiment of the present disclosure.

FIG. 14 is a view of a pattern-shaped electric field forming portion in accordance with another embodiment of the present disclosure.

Referring to FIG. 14, the first electrode portion 1110 may extend from a center in a spiral structure and the second electrode portion 1120 may extend in a spiral structure which surrounds the first electrode portion 1110. As a result thereof, an electric field may be formed in the heating space W where the first electrode portion 1110 and the second electrode portion 1120 are formed to be spaced apart and water, a detergent, or a wash liquid and laundry including the same may be heated by the electric field.

The washing machines in accordance with several embodiments described above may include a function of drying laundry in the washing space. For example, a washing machine including a drying function may further include a dried air inlet duct which supplies dried air to a washing space, an air outlet which discharges the air in the washing space, and a dehumidifying portion which removes humidity in the washing space.

Also, the electric field forming portion described above may be applied not only to washing machines but also to various washing apparatuses such as dish washers, medical instrument washers, wet cleaners, etc.

Meanwhile, the washing machines 1, 2, 3, 4, and 5 in accordance with the embodiments described above may each further include an additional unit which electrolyzes water supplied from an external water source and supplies alkaline water and acidic water.

Figure 15:
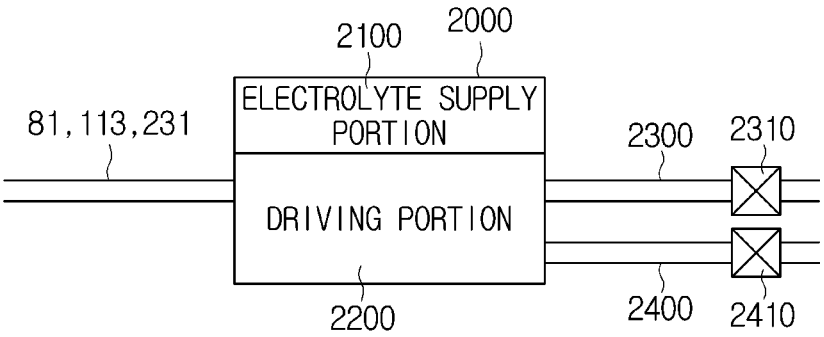
FIG. 15 is a view of an electrolyzing apparatus in accordance with one embodiment of the present disclosure.

FIG. 15 is a view of an electrolyzing apparatus 2000 in accordance with one embodiment of the present disclosure.

One side of the electrolyzing apparatus 2000 may be provided at the water supply pipes 81, 113, 231, etc. connected to the external water source. Referring to FIG. 15, the electrolyzing apparatus 2000 in accordance with one embodiment of the present disclosure may include a driving portion 2200 which electrolyzes water supplied from an external water source and an electrolyte supply portion 2100 which supplies electrolytes for electrolyzation.

The driving portion 2200 may electrolyze the water transferred from the water source using electrolytes supplied from the electrolyte supply portion 2100. As a result thereof, the driving portion 2200 may generate the acidic water and alkaline water.

Also, the electrolyzing apparatus 2000 may further include an alkaline water supply pipe 2300 and an acidic water supply pipe 2400 provided at one end of the driving portion 2200 to supply the alkaline water or acidic water as necessary. An alkaline water supply valve 2310 and an acidic water supply valve 2410 are provided at the alkaline water supply pipe 2300 and the acidic water supply pipe 2400, thereby controlling supply of the alkaline water and acidic water.

The electrolyzing apparatus 2000 in accordance with one embodiment of the present disclosure may open the acidic water supply valve 2410 and may cut off the alkaline water supply valve 2310 to provide the acidic water during a washing operation. Also, the electrolyzing apparatus 2000 in accordance with one embodiment of the present disclosure may cut off the acidic water supply valve 2410 and may open the alkaline water supply valve 2310 to provide the alkaline water during a sterilization operation.

Through this, the electrolyzing apparatus 2000 may provide water for providing optimal efficiency in each operation.

Figure 16:
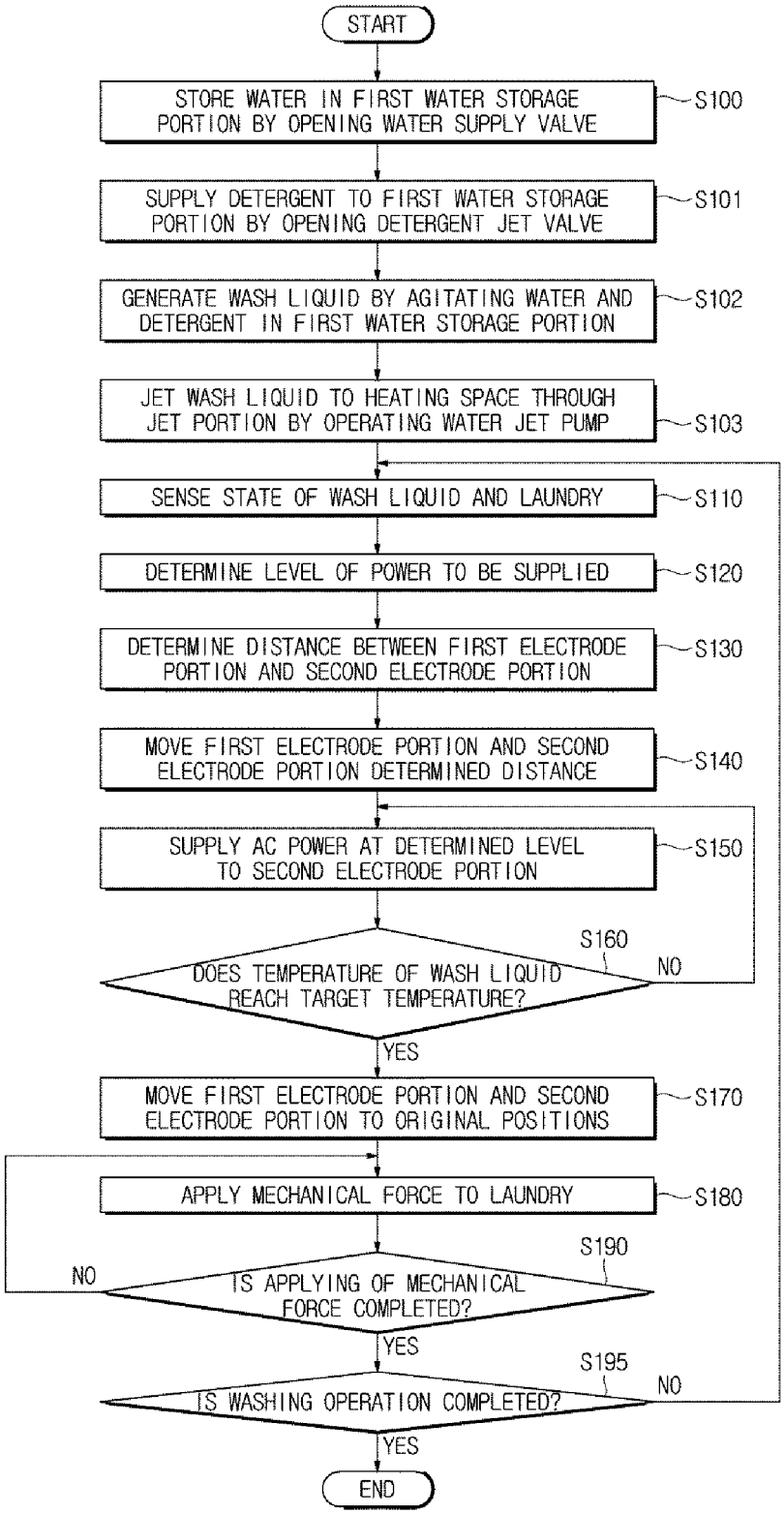
FIG. 16 is a flowchart illustrating a process of performing a washing operation in a method of controlling a washing machine in accordance with one embodiment of the present disclosure.

FIG. 16 is a flowchart illustrating a process of performing a washing operation in a method of controlling a washing machine in accordance with one embodiment of the present disclosure.

First, a washing machine may open the water supply valve 232 to store water in the first water storage portion 233 (S100). Next, the washing machine may supply a detergent to the first water storage portion 233 by opening the detergent jet valve 262 (S101) and may generate a wash liquid by agitating the water in the first water storage portion 233 with the detergent (S102).

When the wash liquid is generated, a water supply portion of the washing machine operates the jet valve 235 to jet the wash liquid to the heating space W in a washing space of a housing (S103). Here, the housing may be embodied as at least one of the rotating tub 30 of FIG. 2A, the rotating tub 30 and the auxiliary washing space of FIG. 2B, the drum 130 of FIGS. 3A and 3B, the cabinet 210 of FIGS. 4A and 4B, and the cabinet 280 of FIG. 5. The wash liquid may include the detergent present as ions. Also, the heating space W may be an area which is a space between the first electrode portion 1110 and the second electrode portion 1120 and in which an electric field is formed.

After supply of the wash liquid, a sensor portion of the washing machine may sense states of the wash liquid and laundry positioned in the heating space W (S110). Here, the state of the wash liquid sensed by the sensor portion may include at least one of a weight, temperature, and volume of the wash liquid and an electric signal transmitted to an electrode, and the state of the laundry sensed by the sensor portion may include at least one of a weight, temperature, and volume of the laundry and an electric signal transmitted to an electrode.

Next, the controller 400 may determine a level of AC power to be supplied based on a sensing result (S120). Also, the controller 400 may determine a distance between the first electrode portion 1110 and the second electrode portion 1120 based on the sensing result (S130). After determining of the distance between the electrode portions, the controller 400 may control the electrode movement portion 600 to space the first electrode portion 1110 and the second electrode portion 1120 apart by the determined distance (S140). Also, the controller 400 may control a power supply portion to supply the AC power at the determined level to the second electrode portion 1120 (S150).

When the AC power is supplied to the second electrode portion 1120, an electric field may be formed in the heating space W provided between the first electrode portion 1110 and the second electrode portion 1120. Electric fields are alternated corresponding to a frequency of the AC power, and as a result thereof, ions of the wash liquid positioned in the heating space W vibrate, thereby heating the wash liquid.

After that, the controller 400 may check whether a temperature of the wash liquid reaches a target temperature (S160). When the temperature of the wash liquid does not reach the target temperature, the power supply portion may be controlled again to supply the AC power to the second electrode portion 1120.

Otherwise, when the temperature of the wash liquid reaches the target temperature, the controller 400 may control the electrode movement portion 600 to move the first electrode portion 1110 and the second electrode portion 1120 to original positions thereof (S170).

After the first electrode portion 1110 and the second electrode portion 1120 are moved to the original positions, the controller 400 may control the driving portion 900 to apply a mechanical force to the laundry (S180). Here, the driving portion 900 may include a pressurizing unit which periodically or aperiodically applies a pressure to laundry and/or a rotating unit which periodically or aperiodically rotates laundry.

After that, the controller 400 may check whether applying of the mechanical force is completed (S190). When the applying of the mechanical force is not yet completed, the controller 400 may control the driving portion 900 to continuously apply the mechanical force to the laundry.

Otherwise, when the applying of the mechanical force is completed, the controller 400 may check whether the washing operation is completed (S195). When the washing operation is not yet completed, it is possible to return to operation S110. Otherwise, when the washing operation is completed, the process is finished.

The washing machine in accordance with one embodiment of the present disclosure may heat not only the wash liquid including the detergent as ions but also water used for a rinsing operation.

Figure 17:
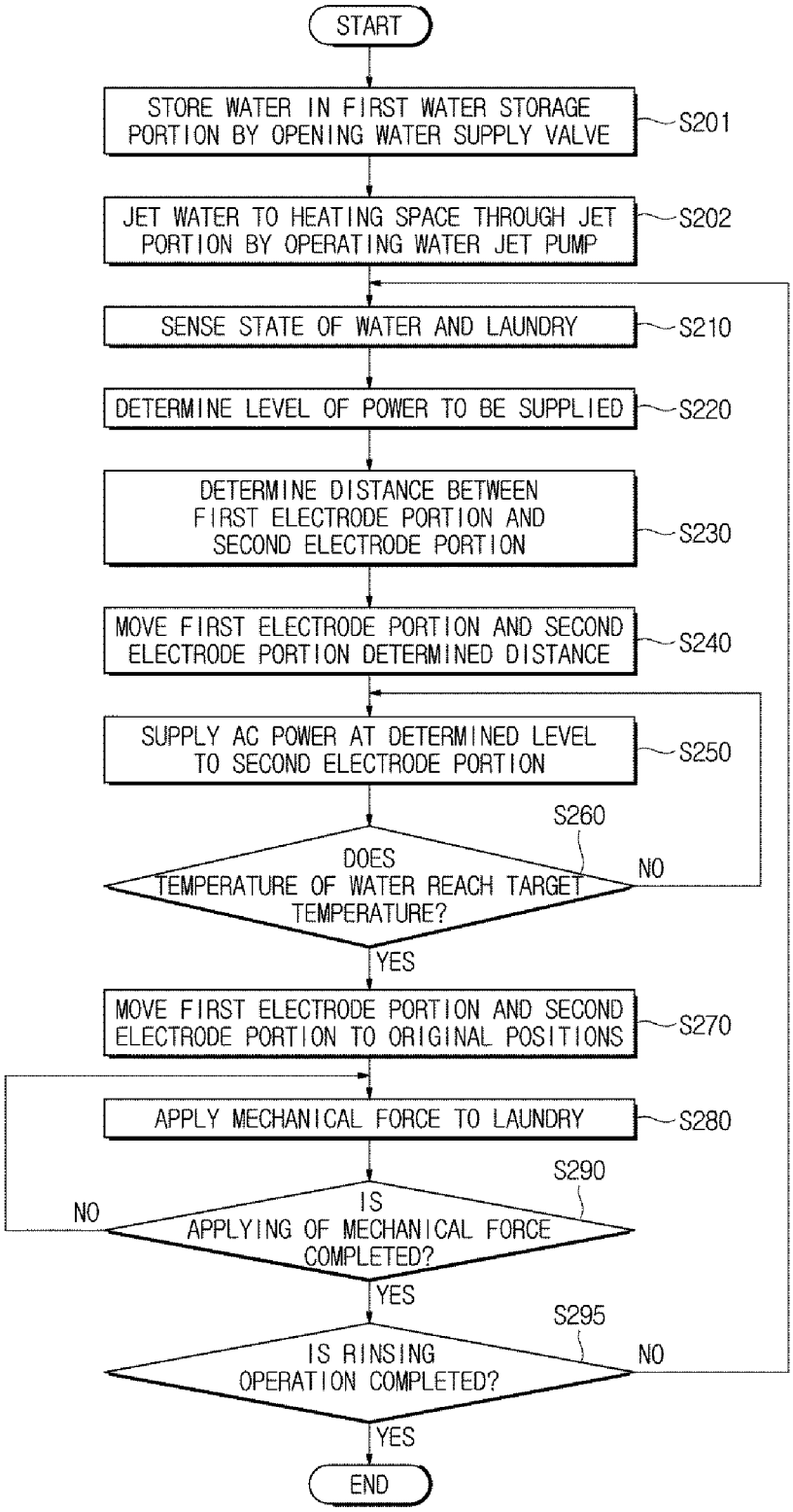
FIG. 17 is a flowchart illustrating a process of performing a rinsing operation in the method of controlling the washing machine in accordance with one embodiment of the present disclosure.

FIG. 17 is a flowchart illustrating a process of performing a rinsing operation in the method of controlling the washing machine in accordance with one embodiment of the present disclosure.

First, a washing machine may open the water supply valve 232 to store water in the first water storage portion 233 (S201).

When the water is stored in the first water storage portion 233, a water supply portion of the washing machine may supply the water to the heating space W in a washing space of a housing (S202). Here, the housing may be embodied as at least one of the rotating tub 30 of FIG. 2A, the rotating tub 30 and the auxiliary washing space of FIG. 2B, the drum 130 of FIGS. 3A and 3B, the cabinet 210 of FIGS. 4A and 4B, and the cabinet 280 of FIG. 5. The water may not include a detergent. Also, the heating space W may refer to an area which is a space between the first electrode portion 1110 and the second electrode portion 1120 and in which an electric field is formed.

After supply of the water, a sensor portion of the washing machine may sense states of the water and laundry positioned in the heating space W (S210). Here, the state of the water sensed by the sensor portion may include at least one of a weight, temperature, and volume of the water, and the state of the laundry sensed by the sensor portion may include at least one of a weight, temperature, and volume of the laundry.

Next, the controller 400 may determine a level of AC power to be supplied based on a sensing result (S220). Also, the controller 400 may determine a distance between the first electrode portion 1110 and the second electrode portion 1120 based on the sensing result (S230). After determining of the distance between the electrode portions, the controller 400 may control the electrode movement portion 600 to space the first electrode portion 1110 and the second electrode portion 1120 apart by the determined distance (S240). Also, the controller 400 may control a power supply portion to supply the AC power at the determined level to the second electrode portion 1120 (S250).

When the AC power is supplied to the second electrode portion 1120, an electric field may be formed in the heating space W provided between the first electrode portion 1110 and the second electrode portion 1120. Electric fields are alternated corresponding to a frequency of the AC power, and as a result thereof, polarized water molecules positioned in the heating space W vibrate, thereby heating the water.

After that, the controller 400 may check whether a temperature of the water reaches a target temperature (S260). When the temperature of the water does not reach the target temperature, the power supply portion may be controlled again to supply the AC power to the second electrode portion 1120.

Otherwise, when the temperature of the water reaches the target temperature, the controller 400 may control the electrode movement portion 600 to move the first electrode portion 1110 and the second electrode portion 1120 to original positions thereof (S270).

After the first electrode portion 1110 and the second electrode portion 1120 are moved to the original positions, the controller 400 may control the driving portion 900 to apply a mechanical force to the laundry (S280). Here, the driving portion 900 may include a pressurizing unit which periodically or aperiodically applies a pressure to laundry and/or a rotating unit which periodically or aperiodically rotates laundry.

After that, the controller 400 may check whether applying of the mechanical force is completed (S290). When the applying of the mechanical force is not yet completed, the controller 400 may control the driving portion 900 to continuously apply the mechanical force to the laundry.

Otherwise, when the applying of the mechanical force is completed, the controller 400 may check whether the rinsing operation is completed (S295). When the rinsing operation is not yet completed, it is possible to return to operation S210. Otherwise, when the rinsing operation is completed, the process is finished.

Figure 18:
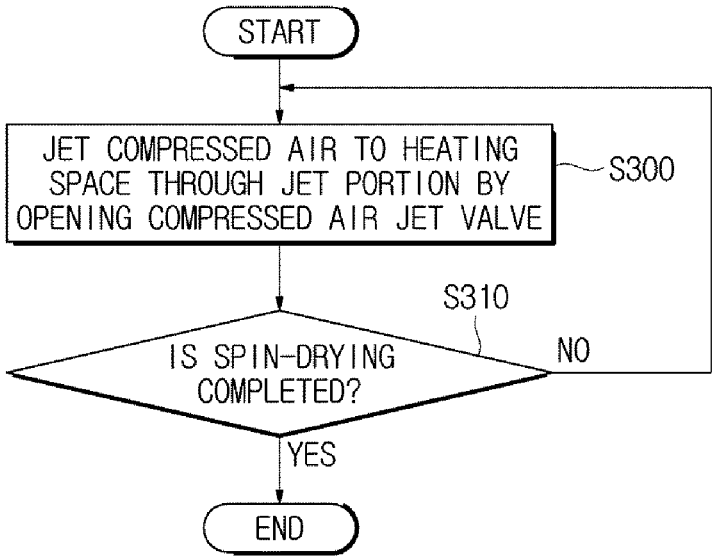
FIG. 18 is a flowchart illustrating a process of performing a spin-drying operation in the method of controlling the washing machine in accordance with one embodiment of the present disclosure.

FIG. 18 is a flowchart illustrating a process of performing a spin-drying operation in the method of controlling the washing machine in accordance with one embodiment of the present disclosure.

First, a washing machine may jet compressed air to a heating space through a jet portion by opening a compressed air jet valve (S300). Through this, water, a detergent, or a wash liquid may be separated from laundry.

After that, the controller 400 may check whether a spin-drying operation is completed (S310). When the spin-drying operation is not yet completed, it is possible to return to operation S300. Otherwise, when the spin-drying operation is completed, the process is finished.

As is apparent from the above description, a washing machine and a method of controlling the same in accordance with one embodiment of the present disclosure may uniformly heat water, a detergent, or a wash liquid by using a dielectric heating method. As a result, efficiency of energy used for heating the water, the detergent, or the wash liquid by the washing machine may be improved and washing performance may be increased due to ionic activation of the detergent.

Although a few embodiments of the present disclosure have been shown and described, it would be appreciated by those skilled in the art that changes may be made in these embodiments without departing from the principles and spirit of the present disclosure, the scope of which is defined in the claims and their equivalents.

What is claimed is:

1. A method comprising:

supplying a wash liquid comprising water and a detergent to a washing space of a washing machine;

sensing, in the washing space, a state of at least one of the wash liquid and laundry comprising the wash liquid, and providing a sensing result of the sensing; and forming, in the washing space, an electric field between a first electrode portion in the washing space and a second electrode portion in the washing space, with the laundry comprising the wash liquid being in the washing space, so as to expose the laundry to the electric field when the laundry is between the first electrode portion and the second electrode portion, by supplying alternating current (AC) power at a level corresponding to the sensing result to the second electrode portion.

2. The method of claim 1, wherein the sensing comprises sensing, in the washing space, at least one of a weight of the wash liquid, a temperature of the wash liquid, a volume of the wash liquid, a weight of the laundry comprising the wash liquid, a temperature of the laundry comprising the wash liquid, and a volume of the laundry comprising the wash liquid.

3. The method of claim 1, wherein the forming comprises performing impedance matching based load impedance of the laundry according to the sensing result.

4. The method of claim 1, further comprising:

spacing the first electrode portion and the second electrode portion to be apart by a distance corresponding to the sensing result.

5. The method of claim 1, further comprising:

heating the wash liquid in the washing space using the electric field.

6. The method of claim 5, wherein the forming comprises alternately forming electric fields in the washing space according to a frequency of the supplied AC power, and the heating comprises heating the wash liquid by vibrating ions in the wash liquid according to the alternately formed electric fields.

7. A method comprising:

supplying a wash liquid comprising water and a detergent to a washing space of a washing machine;

sensing, in the washing space, at least one of weight of the wash liquid, volume of the wash liquid, weight of laundry comprising the wash liquid, and volume of the laundry comprising the wash liquid, and providing a sensing result of the sensing; and forming, in the washing space, an electric field between a first electrode portion in the washing space and a second electrode portion in the washing space, with the laundry comprising the wash liquid being in the washing space, so as to expose the laundry to the electric field when the laundry is between the first electrode portion and the second electrode portion, by supplying alternating current (AC) power at a level corresponding to the sensing result to the second electrode portion.

8. The method of claim 7, wherein the sensing senses the weight of the wash liquid.

9. The method of claim 7, wherein the sensing senses the volume of the wash liquid.

10. The method of claim 7, wherein the sensing senses the weight of the laundry comprising the wash liquid.

11. The method of claim 7, wherein the sensing senses the volume of the laundry comprising the wash liquid.

12. The method of claim 7, wherein the forming comprises performing impedance matching based load impedance of the laundry according to the sensing result.

* * * * *